United States Patent [19]

Allen et al.

[11] Patent Number: 4,850,423

[45] Date of Patent: Jul. 25, 1989

[54] AIR PREHEATER WATER JET CLEANING APPARATUS

[75] Inventors: John T. Allen, Duncan; Alan J. Pitts, Comanche, both of Okla.; Don M. Roberts, Coppell, Tex.; Randall B. Cogbill, Ft. Smith, Ark.

[73] Assignee: Halliburton Company, Duncan, Okla.

[21] Appl. No.: 154,736

[22] Filed: Feb. 10, 1988

[51] Int. Cl.[4] ..... F28D 17/00; F28G 9/00

[52] U.S. Cl. ..... 165/5; 134/46; 134/172

[58] Field of Search ..... 165/5; 134/46 R, 172

[56] References Cited

U.S. PATENT DOCUMENTS

| | | | |
|---|---|---|---|
| 2,761,653 | 9/1956 | Grames et al. | 165/5 |
| 3,985,161 | 10/1976 | Nelson | 239/185 |
| 4,041,899 | 8/1977 | Wolfe et al. | 118/323 |
| 4,256,511 | 3/1981 | Atchison et al. | 134/46 |
| 4,466,572 | 8/1984 | Shelton | 239/186 |
| 4,503,811 | 3/1985 | Hammond | 122/392 |

FOREIGN PATENT DOCUMENTS

| | | | |
|---|---|---|---|
| 1186972 | 3/1959 | France | 165/5 |

OTHER PUBLICATIONS

Weatherford Sales Brochure, Air Preheater Cleaning System, Sections 1, II, V.

*Primary Examiner*—Albert W. Davis, Jr.
*Attorney, Agent, or Firm*—Mark E. McBurney

[57] ABSTRACT

An air preheater water jet apparatus is provided for cleaning fly ash, soot and the like from a rotating or stationary heat exchange basket on a air preheater used to improve the efficiency of a boiler in an electric utility generating plant. The air preheater cleaning apparatus includes a cleaning assembly with water jet nozzles, thereon, attached to a carriage which moves along a track, such as a channel beam, affixed radially above and adjacent to the air preheater basket. A drive assembly and an idler bracket assembly with a roller chain therebetween are disposed on the channel beam. The carriage assembly is attached to the roller chain and as the carriage is driven, the cleaning assembly is moved along the channel beam. Thus, when the basket, or the air preheater cleaning apparatus, is rotated and the carriage is moved inward, a circular path of the basket is cleaned. Additionally, a variable speed motor control apparatus is used to increase the air preheater rotational speed as the carriage assembly moves inward, such that the relative speed between the cleaning assembly and the air preheater basket remains constant as inward movement occurs.

36 Claims, 12 Drawing Sheets

AIR PREHEATER WATER JET CLEANING APPARATUS

BACKGROUND OF THE INVENTION

In the electric utility industry, it is common practice to "preheat" air which is being input to a boiler, or steam generator used in conjunction with a turbine-generator for generating electrical power. By preheating input air used for combustion, the amount of fuel required to produce a certain amount of energy is reduced and thus boiler efficiency is improved.

The input air is heated through a type of heat exchanger known in the industry as an air preheater. Exhaust gases, containing heat energy emitted from the boiler, are used to heat a number of heat exchange elements which are configured in the shape of a porous wheel and are commonly referred to as a basket. This basket may be as large as 50 to 60 feet in diameter and 10 feet thick and may be oriented either vertically, or horizontally.

The exhaust gases are directed, via an exhaust duct, to flow through approximately one-half of the basket, thus transferring the heat energy from the exhaust gas to a specific area of the basket. Simultaneously, input air flows via an input air duct through the other half of the basket. Transfer of the heat energy from the basket to the input air occurs as the basket is rotated, wherein the heated portion passes through the input air flow and thus the input air is heated up.

Two types of air preheaters are widely used, the first being a Ljungstrom as described above. The second is a Rothmuhle which operates in a similar fashion to the Ljungstrom, however the basket remains stationary and the air input duct is rotated about a bearing. Therefore, the input air is heated as it flows through the basket, which has obtained the heat energy from the exhaust gas.

In electric power plants, particularly those using coal for fuel, the exhaust gas from the boiler contains large quantities of particulate matter, specifically fly ash and soot which tend to clog the basket after continued use. This clogging of the basket restricts the flow of the input air and the exhaust gas, thus causing a significant drop in efficiency.

Cleaning the air preheater basket has been a major problem and a significant cause of costly down time throughout the electric utility industry. Previous cleaning methods include using fire hoses and air pressure to remove fly ash from the baskets, but these methods have only met with partial success. Alternatively, replacing the baskets has been another solution to the low efficiency problem caused by a clogged air preheater basket, however this is extremely costly in terms of down time and expense.

An air preheater cleaning apparatus is disclosed by U.S. Pat. No. 4,256,511 to Atchison, et al, which provides an automatic jet wash system for cleaning the air preheater baskets. Atchison et al states that the air preheater cleaning system can be used to clean air preheaters of other than the Ljungstrom type, however it does not seem possible to use the Atchison et al system on a Rothmuhle air preheater wherein the air input duct is rotated with respect to a stationary basket. For example, no pivot or swivel assembly is provided which would prevent the microswitch lead and air supply line from becoming tangled upon rotation of the air preheater cleaning apparatus. Another disadvantage of Atchison et al is that the basket is rotated at a constant rate of speed, unless manually increased, and as the water jet moves inward, the speed of the rotating basket with respect to the water jet slows down. Therefore, costly down time is unnecessarily used for cleaning, where if the rotational speed of the basket could be increased as the jet moves inward, down time could be reduced.

Another automatic air preheater cleaning system is manufactured by Weatherford Water Jetting Systems. The Weatherford cleaner does increase the rotational speed of the basket during cleaning, but the system contains several other drawbacks. Particularly, as in Atchison et al, the Weatherford system cannot be used on Rothmuhle type air preheaters and an electric motor is used to drive the jet head assembly. Moreover, the control system in the Weatherford cleaner uses a clock and an assumed basket speed in order to calculate the rotational basket speed increases which take place as the jet assembly moves inward, and further the control system does not provide job interrupt and reset functions. Another disadvantage of the Weatherford system is the fact that only a single jet head nozzle is utilized, thus limiting the amount of basket surface which can be cleaned per revolution.

In view of the foregoing disadvantages and drawbacks in the art, an air preheater cleaning system such as the present invention which can be used on both Ljungstrom and Rothmuhle type air preheaters and in conjunction with variable speed control apparatus is highly desirable. Further, the present invention utilizes a totally pneumatic water jet drive and logic system, provides interrupt and reset functions and uses a motion sensing device for determining actual position values, rather than using assumed values. Therefore, a greater amount of flexibility and control over an air preheater cleaning job is provided by the present invention and the amount of down time experienced by the electric utility is held to a minimum.

SUMMARY OF THE INVENTION

The present invention, in contrast with the prior art, provides a cleaning apparatus which can be used to automatically clean an air preheater using totally pneumatic power and control logic. Additionally, on jobs where time is of the essence, a variable speed control system can be used to increase the rotational speed of the basket, or air input duct, depending on whether a Ljungstrom or Rothmuhle air preheater is being cleaned. The variable speed control system allows the speed of the cleaning water jets, with respect to the cleaning surface, to be constant regardless of the position of the water jets along the radius of the basket or input air duct.

The present invention includes a cleaning device having a water jet manifold with a number of water jets which emit high pressure fluid (normally water) used for cleaning the fly ash, soot and any other particulate matter from the air preheater.

A carriage is provided which moves along a radial path which extends from the center of the air preheater to the outside circumference. The cleaning device is rigidly affixed to the carriage and as the air preheater is rotated, the cleaning device moves inward much in the same way as a phonograph record is played.

A pneumatic drive assembly is used to provide the force which moves the carriage along the radial path.

Next, a bracket assembly is included which provides support for the carriage and further includes a pneumatic limit switch which issues a signal to a pneumatic logic control circuit for halting the movement of the carriage upon contact with the pneumatic limit switch.

A motion detector is utilized which senses the actual rotating movement of the air preheater and provides a pneumatic pulse to the pneumatic logic control circuit, varying in accordance with the detected rotational movement.

The pneumatic logic control circuit includes a first counter which receives and counts the pneumatic pulses from the motion detector and an associated reset circuit which resets the first counter after a predetermined number of pneumatic pulses are received. A manual drive valve and a reverse drive valve are provided which initiate carriage movement toward or away from the air preheater center. The aforementioned pneumatic logic control circuit components are located in a control box, whereas the following pneumatic logic control circuit components are located in the drive assembly The pneumatic logic control circuit components located in the drive assembly include a second counter which measures the movement of the carriage and an associated reset circuit which resets the second counter after the carriage has moved a predetermined distance. A time delay circuit is provided which prevents the drive assembly from operating during the time period when the second reset circuit is operating. Further, a stop circuit is included which halts the carriage movement upon receipt of the stop signal issued by the pneumatic limit switch.

The control box pneumatic logic components, are connected to the drive assembly pneumatic logic control circuit components by two air hose assemblies, one for the reverse signal to the drive assembly, and the other being for pneumatic control logic and motor drive power. Moreover, the pneumatic logic control circuit has the capability of outputting a voltage signal, indicating the inward movement of the carriage, to the variable speed control system, when it is utilized.

On Rothmuhle jobs, a swivel assembly is provided which allows the air preheater cleaning apparatus to rotate 360° since it must be attached to the air input duct of the air preheater which rotates with respect to a stationary basket. The high pressure water and pneumatic control logic and motor drive power are then routed, via the swivel assembly, to the cleaning device and the pneumatic logic control circuit, located on the drive assembly, respectively.

The variable speed control system is capable of being added to either a Ljungstrom or Rothmuhle air preheater cleaning operation such that an electric induction motor is operatively connected to the air preheater and rotates same based upon a command output from a central processing unit or a manual control panel.

The central processing unit calculates a desired rotational speed based upon previously programmed job data ( i.e. air preheater characteristics such as air preheater basket outside diameter, air preheater basket inside diameter, desired surface velocity of the air preheater with respect to the water jet nozzles and the RPM ratio of the air preheater to the electric motor) and a voltage signal output from the pneumatic control box. The central processing unit then issues a speed control command based on the aforementioned inputs.

A motor controller then varies the frequency of the electric power which is input to the induction motor, thus varying the speed of the motor in accordance with the speed control command issued by the central processing unit.

In accordance with the previous summary, objects, features and advantages of the present invention will become apparent to one skilled in the art from the subsequent description and the appended claims taken in conjunction with the accompanying drawings.

BRIEF DESCRIPTION OF THE DRAWINGS

FIG. 18 is a block diagram illustrating the control and operation of the variable speed control apparatus of the present invention;

FIG. 19 is a schematic wiring diagram illustrating the interconnection between he various components of the variable speed control;

DETAILED DESCRIPTION OF THE PREFERRED EMBODIMENTS

Figure 1:
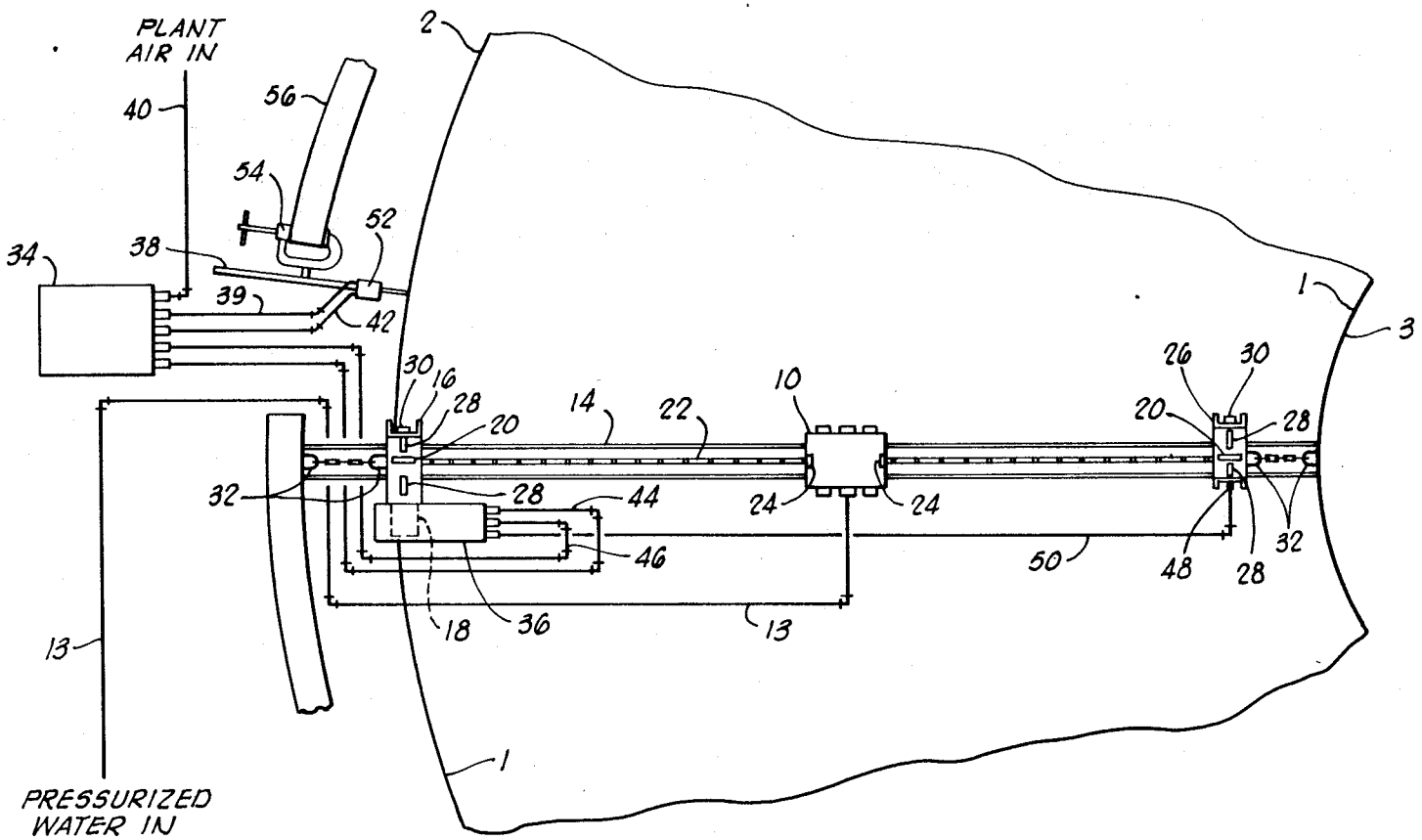
FIG. 1 is a plan view of a first embodiment of the present invention as used for cleaning a Ljungstrom air preheater.

Referring to FIG. 1, an air preheater cleaning apparatus according to a first embodiment of the present invention is shown. An air preheater basket 1 is defined by outside circumference 2 and an inside annulus 3. FIG. 1 is a Ljungstrom type air preheater and under norma operating conditions, basket 1 is rotated by a power source such as an electric motor, pneumatic motor, or the like (not shown) to effect heat transfer.

As basket 1 is rotated, carriage assembly 10 with a cleaning assembly 12 (FIG. 2) attached thereto, moves incrementally radially inward (toward inside annulus 3) along a line which is parallel to the plane of basket 1 and extends from outside circumference 2 to inside annulus 3. Pressurized fluid which is normally water, but may include a cleaning solution, corrosion inhibiting solution, or the like is input from an outside source via hose assembly 13. This pressurized water which is routed to cleaning assembly 12 may be as high as 10,000 psi. As basket 1 rotates and passes under cleaning assembly 12 the pressurized water is emitted in such a direction as to contact basket 1, thus cleaning of a circular path around basket 1 is accomplished.

Support means 14 is permanently affixed above the air preheater basket by welding, bolting, or the like, and may include a channel beam, box beam or wide flange beam of varying dimensions which is used to provide a track along which carriage assembly 10 moves. Drive assembly 16 is utilized to provide the force required to move carriage assembly 10 along support means 14.

Figure 5:
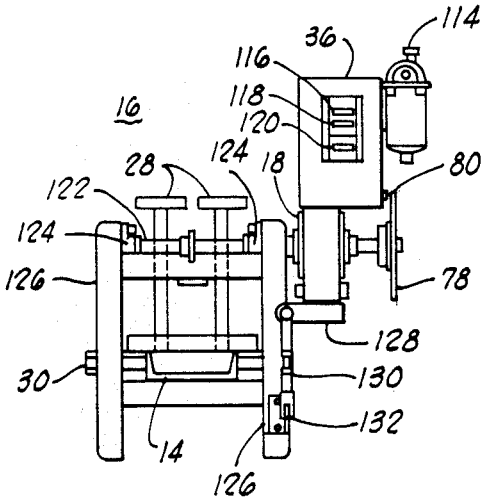
FIG. 5 is a crossectional view of FIG. 4 taken along line 5—5, showing the inside elevation of the drive assembly.

Drive assembly 16 includes a pneumatic motor 18 which has a sprocket 20 attached to a shaft 122 (FIG. 5). A roller chain 22 engages sprocket 20 and is connected on carriage assembly 10 at the end nearest drive assembly 16 by connection means 24 which may include a pin, threaded connector, or the like. Additionally, sprocket 20 can be removed and pneumatic motor 18 can be rotated 90° such that a threaded rod can be used to drive carriage 10 when connected to shaft 122 and drive carriage 10.

Idler bracket assembly 26 includes a sprocket 20 which completes the path along which roller chain 22 travels from carriage assembly 10 back to drive assembly 16. A second connection means 24 effects a mechanical connection between roller chain 22 and carriage assembly 10 on the side of carriage assembly 10 nearest idler bracket assembly 26.

Both idler bracket assembly 26 and drive assembly 16 are attached to support means 14 by clamps 28 and centering bolts 30. Further, anchors 32 are provided on the idler bracket assembly 26 at the end nearest inside annulus 3 and on drive assembly 16 at the end nearest outside circumference 2 of basket 1. Anchors 32 provide tensional support for drive assembly 16 and idler bracket 26 as carriage assembly 10 is moved along support means 14.

FIG. 1 also shows the components used by the present invention in a first embodiment to effect pneumatic control over the movement of carriage assembly 10. Control box 34 houses a portion of the pneumatic logic control circuit, while drive assembly 16 houses the remaining portion of the pneumatic logic control circuit in a compartment 36.

Motion detector 38 senses the rotational movement of basket 1 and outputs a pneumatic pulse to control box 34, via hose assembly 42. Motion detector 38 includes a sensing means 52 which detects the rotational movement of basket 1 and further includes a securing means such as a "C" clamp, or the like. Securing means 54 affixes motion detector 38 to a beam 56, disposed near the air preheater, at a position wherein a sensing means 52 contacts the outside circumference 2 of basket 1.

Control box 34 receives a pneumatic supply input, from a source at the job site, and supplies pneumatic control power to motion detector 38 through hose assembly 39. Further, control box 34 supplies pneumatic power to drive assembly 16 via hose assemblies 44 and 46. Hose assembly 44 provides pneumatic power to pneumatic motor 18 and pneumatic power for the pneumatic logic control circuit which is housed in compartment 36. Hose assembly 46 provides pneumatic power for effecting reverse motion (in a direction toward drive assembly 16) of carriage assembly 10.

Idler bracket assembly 26 includes pneumatic limit switch 48 which limits the inward (in a direction toward bracket assembly 26) travel of carriage assembly 10 by issuing a pneumatic stop signal, via hose assembly 50 to the portion of the pneumatic logic control circuit housed in compartment 36. The pneumatic limit switch 48 issues the stop signal to the pneumatic logic control circuit upon contact with carriage assembly 10.

Figure 2:
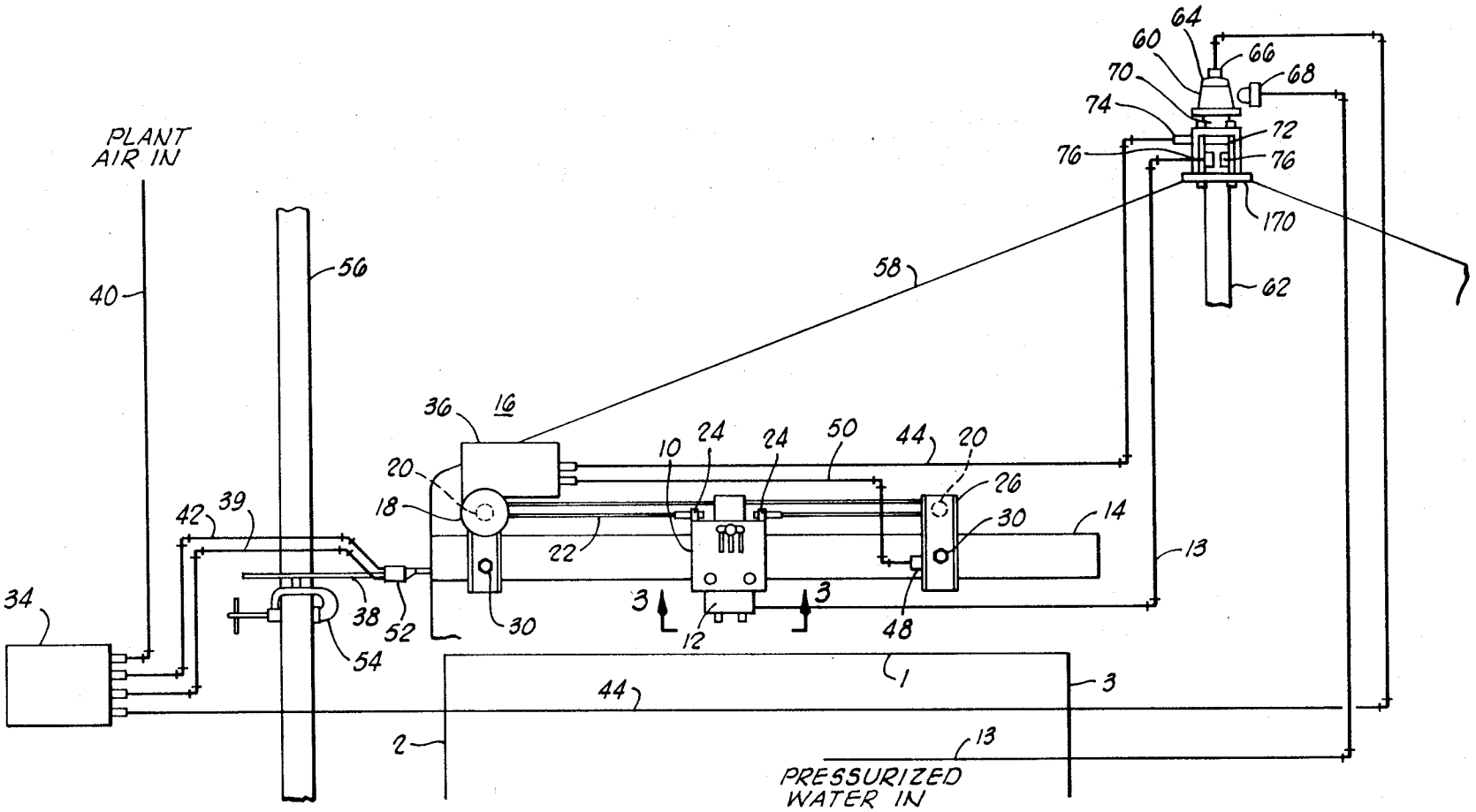
FIG. 2 is an elevational view of the present invention showing the major components used in a Rothmuhle cleaning job.

FIG. 2 depicts a Rothmuhle air preheater cleaning apparatus which is very similar to the apparatus depicted in FIG. 1. However, in Rothmuhle type air preheaters, the air input duct 58 rotates with respect to a stationary basket 1. The major components of the air preheater cleaning apparatus of FIG. 2 are identical to those of FIG. 1 with the exception that a swivel assembly 60 is provided which allows the drive assembly 16, carriage assembly 10, cleaning assembly 12, idler bracket assembly 26 and associated connecting devices to rotate 360° with respect to the stationary basket 1. Support means 14 is rigidly affixed to the air input duct 58. As previously discussed, a drive source such as an electric motor, a pneumatic motor, or the like (not shown) drives the air input duct 58 such that a circular path of basket 1 is cleaned as cleaning assembly 12 circularly passes adjacent to basket 1.

Swivel assembly 60 is mounted to air input duct 58 upon a shaft 62. Generally, a shaft 62 which runs through the center of air preheater duct is cut and flanges 170 are used in conjunction with bolts 168 (FIG. 13) to connect swivel assembly 60 into shaft 62.

Pressurized water is then routed from an outside source to cleaning assembly 12 via hose 13 and swivel assembly 60. Pneumatic control power is supplied from control box 34 to the pneumatic logic control circuit housed in compartment 36 via hose assembly 44 and swivel assembly 60. Swivel assembly 60 includes a stationary input manifold 64 which has pneumatic input fitting 66 and water input nozzle 68 disposed thereon. Rotating coupling 70 allows pressurized water and pneumatic power, which are input to swivel assembly 60, to pass into rotating output manifold 72. Rotating output manifold 72 rotates synchronously with air input duct 58 and includes pneumatic output fitting 74 and water output nozzle 76. Pressurized water is then supplied to cleaning assembly 12 and pneumatic control power is provided to compartment 36 via hose assemblies 13 and 44, respectively.

Figure 4:
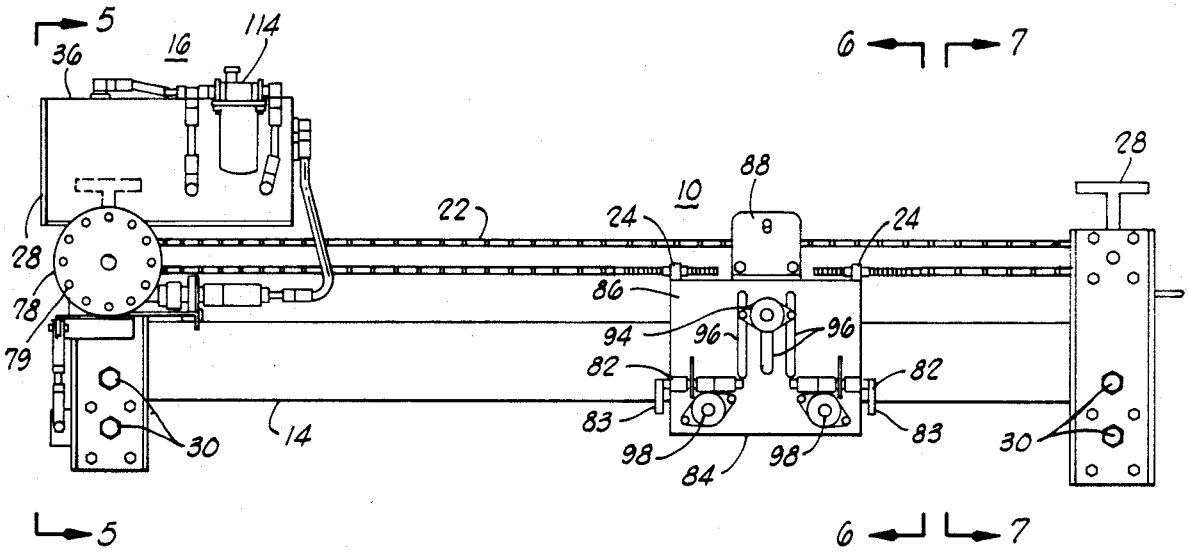
FIG. 4 is an elevational view showing the drive assembly, carriage assembly and idler bracket assembly of the present invention.

FIG. 4 is a side elevational view of drive assembly 16, carriage assembly 10 and idler bracket assembly 26. In addition to the features previously discussed, drive assembly 16 includes carriage motion input wheel 78 which inputs the distance traveled by carriage assembly 10 to the pneumatic logic control circuit housed in compartment 36. Carriage motion input wheel 78 is operatively connected to roller chain 22 through sprocket 20, thus as pneumatic motor 18 drives carriage 10, carriage motion input wheel 78 is also driven. Differently configured holes 79 are disposed along the circumference of carriage motion input wheel 78. Each hole 79 may correspond to a different incremental distance moved by carriage assembly 10 (such as 5/16, ¼, ⅝ inches). Therefore, as carriage assembly 10 moves and carriage motion input wheel 78 is rotated, mechanical counter 80 registers the number of holes 79 contacted and the incremental distance moved can be determined. Therefore, the distance of carriage travel is input to the pneumatic logic control circuit housed in compartment 36.

The side elevational view of carriage assembly 10 in FIG. 4 shows a hinge 82 which is present on both sides of carriage assembly 10 and allows carriage assembly 10 to be mounted around support means 14. The hinges 82 are disconnected by removing retaining clip 81 and hinge pins 83, allowing a lower portion 84 of carriage 10 to become disengaged from upper portion 86 of carriage 10. Thus, carriage 10 can be mounted to encompass support means 14 when hinges 82 are reconnected.

Carriage assembly 10 also includes brackets 88 for supporting roller chain guide 90 (FIG. 6) which provides a surface for roller chain 22 to contact such that roller chain 22 will not become tangled with an edge of carriage 10 as travel along support means 14 occurs.

Carriage assembly 10 also includes a roller 92 (FIG. 6) which is connected on each end to the sides of carriage 10 through roller bearings 94. Roller 92, which is adjustable due to roller slots 96, is set such that roller 92 is placed adjacent to the side of support means 14 which is opposite to basket 1 which is to be cleaned. Guide rollers 98, which are also adjustable due to guide slots 100 (FIG. 8), are set adjacent to the sides of support means 14. Thus, with roller 92 and guide rollers 98, many differently configured support means can be used.

Figure 3:
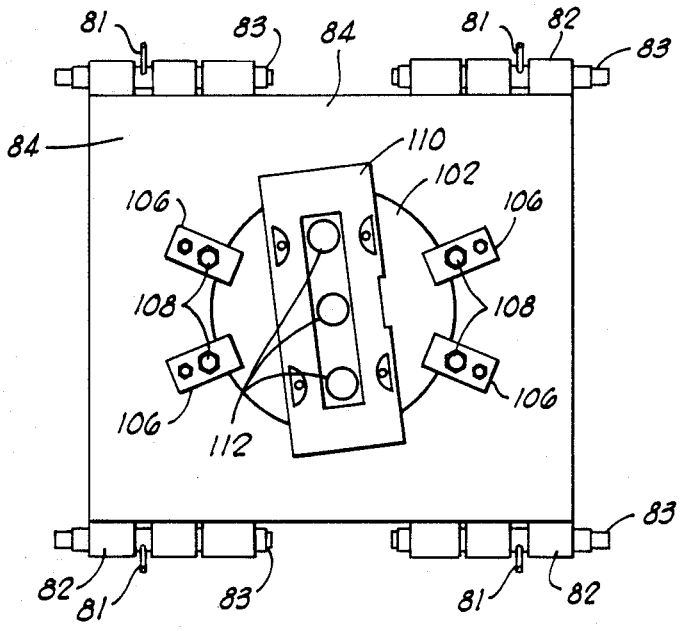
FIG. 3 is a bottom plan view taken along line 3—3 of FIG. 2 illustrating the water jet manifold and water jet nozzles of the cleaning assembly.

In referring to the cleaning assembly 12 of the present invention, FIG. 3 shows a bottom plan view wherein lower carriage portion 84 is shown with hinges 82, hinge pins 83 and retaining clips 81. Near the center of lower carriage portion 84, water jet mounting plate 102 is rigidly affixed to lower carriage portion 84 by connecting means which include clips 106 and threaded connections 108, or the like. Water jet manifold assembly 110 is attached to water jet mounting plate 102 through connecting means as is known in the art.

Pressurized water enters water jet manifold assembly 110 via swivel assembly 60 or directly from a high pressure water source as previously discussed. Pressurized water is directed through the water jet manifold assembly 110 which includes at least one water jet nozzle 112 for directing and intensifying the flow of pressurized water. The effective spacing of water jet nozzles 112 is adjustable by rotating the water jet mounting plate 102, and thus the alignment of water jet nozzles 112, with respect to the path to be cleaned. Further, the number and size of water jet nozzles 112 can be increased or decreased creating a vast range of water jet patterns for air preheater cleaning jobs requiring different cleaning patterns and jet intensities based on the air preheater physical characteristics and the degree of clogging experienced by basket 1.

FIG. 5 is a front side elevational view of drive assembly 16 taken along line 5—5 of FIG. 4. A lubricator 114 adds oil to the pneumatic power which is used to drive the pneumatic motor 18 in order to reduce friction and wear on motor 18.

A counter 116 is mounted on compartment 36 and includes a predetermining counter 118 and a totalizing counter 120. The predetermining counter 118 is set, prior to beginning the cleaning job, to the desired incremental movement of carriage assembly 10 and thus cleaning assembly 12 is moved the desired distance when mechanical counter 80 contacts holes 79 of carriage motion input wheel 78 a predetermined number of times. Totalizing counter 120 records the total amount of travel by carriage assembly 10 for each job. A totalizing counter should be reset prior to beginning each cleaning job. Carriage motion input wheel 78 operates both totalizing counter 120 and predetermining counter 118 via mechanical counter 80.

FIG. 5 further illustrates the support components of drive assembly 16. Shaft 122 connects sprocket 20, motor 18 and carriage motion input wheel 78. Shaft bearing 124 allows shaft 122 to pass through and to be rigidly affixed to beam 126. Compartment 36 rests on the housing of pneumatic motor 18 which is in turn supported by shaft 122. A motor restraint is required to keep pneumatic motor 18 stationary during operation due to the tendency of motor 18 to turn in conjunction with shaft 122. The motor restraint includes motor bracket 128 with motor 18 mounted thereon. Connecting member 130 rigidly connects motor bracket 128 with a bracket 132 which is rigidly affixed to beam 126 with connectors such as bolts, pins, or the like.

Figure 6:
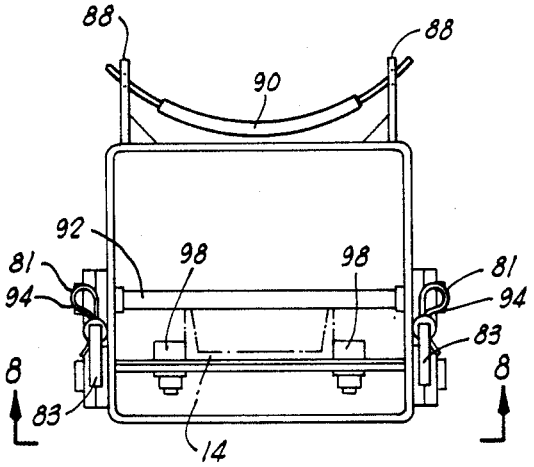
FIG. 6 is a crossectional view of FIG. 4 taken along line 6—6 illustrating the inside elevation of the carriage assembly.

FIG. 6 is a front side elevation of carriage assembly 10 taken along line 8—8 of FIG. 4. Carriage assembly 10 is shown with support means 14 running therethrough. Roller 92, guide rollers 98 and hinge 82 have all been adjusted and set to allow carriage 10 to travel along support means 14, in this case, a channel beam. The adjustment operation and adjusting features of the components of FIG. 6 have been previously discussed with regard to FIGS. 2 and 3.

Figure 7:
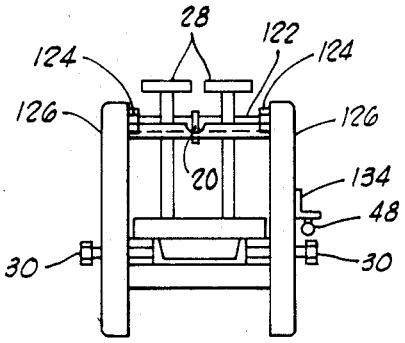
FIG. 7 is a crossectional view showing the outside elevation of the idler bracket assembly as taken along line 7—7 of FIG. 4.

Referring to FIG. 7 an elevational view of idler bracket assembly 26 taken along line 7—7 of FIG. 4 is shown. Idler bracket assembly 26 includes beams 126, clamps 28 and centering bolts 30 which operate to secure idler bracket assembly 26 to support means 14 in the same manner as drive assembly 16 is attached.

Pneumatic limit switch 48 is attached to beam 126 with an "L" bracket 134, which may be angle iron, or the like. Pneumatic limit switch 48 is actually a pneumatic valve which receives pressure from the pneumatic logic control circuit housed in compartment 36. Upon contact with carriage assembly 10, limit switch 48 dumps the received pressure which cuts off the pneumatic supply pressure to pneumatic motor 18. Pneumatic limit switch 48 will be discussed in greater detail in accordance with the pneumatic logic control circuit of FIG. 15.

Figure 8:
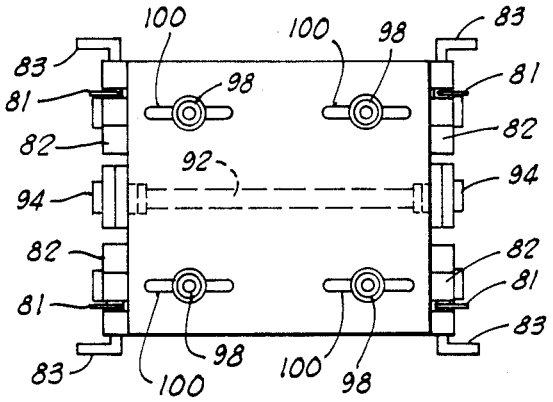
FIG. 8 is a bottom view of the carriage assembly taken along line 8—8 of FIG. 6.

FIG. 8 is a bottom plan view of carriage assembly 10 taken along line 8—8 of FIG. 6. Guide slots 100 which allow guide rollers 98 to adjust to differently configured types of support means 14 are shown. Further, the procedures for mounting carriage assembly 10 onto support means 14 can be understood by one skilled in the art upon viewing hinge 82, hinge pin 83 and retaining clip 81. The position of roller 92 in relation to guide rollers 98 is also apparent when viewing FIG. 8.

Figure 9:
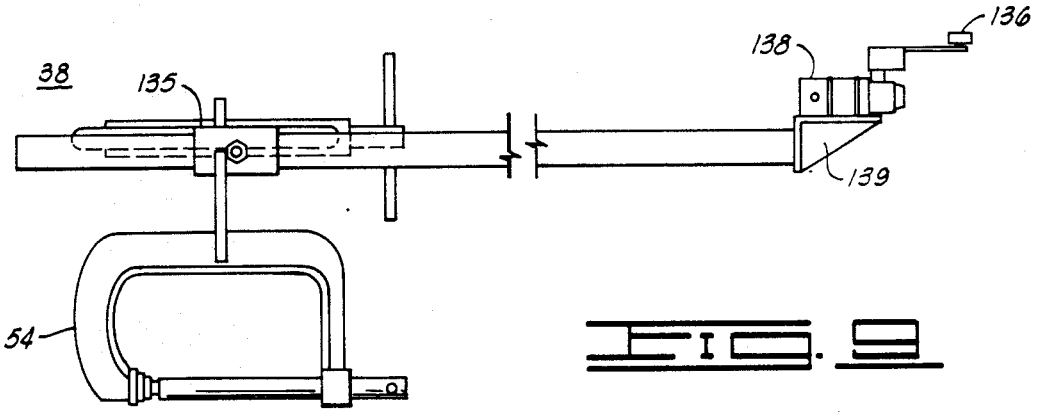
FIG. 9 is a side view of the motion detector as used in the present invention.
Figure 10:
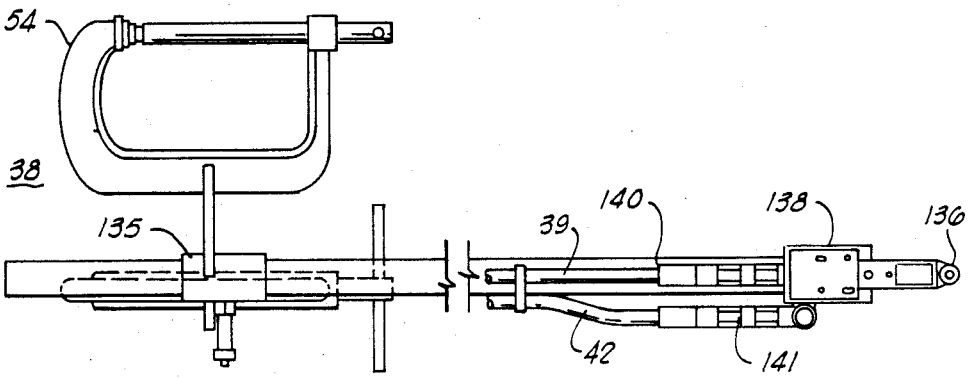
FIG. 10 is a plan view of the motion detector depicting the pneumatic connections thereon.

Motion detector 38 is detailed in FIGS. 9 and 10, wherein FIG. 9 is a side elevational view and FIG. 10 is a top plan view. As previously discussed, motion detector 38 includes securing means 54, sensing means 52 and hose assemblies 39 and 42 which provide pneumatic power to motion detector 38 and the pneumatic pulse output to control box 34, respectively. Securing means 54 are affixed to motion detector 38 by an attachment bracket 135. At least two securing means 54 are provided at 90° intervals with each other, which will allow motion detector 38 to be affixed to either a horizontal or vertically placed beam 56. A valve support 139 attaches pneumatic valve 138, with trip lever 136 thereon, to the main body portion of motion detector 38. Pneumatic fittings 140, 141 effect the connection of hose assemblies 39 and 42, respectively, with control box 34.

In addition to the features previously mentioned, a trip lever 136 is mechanically connected to valve 138. The motion detector is attached at such a position where the trip lever 136 is adjacent to rotating basket 1, on Ljungstrom air preheater cleaning jobs, or adjacent to air input duct 58 on Rothmuhle jobs. Trip lever 136 is aligned with a protrusion along basket 1, or air input duct 58, such that as rotation occurs the protrusion trips the trip lever 136 a known number of times per each rotation.

For example, 15 welding seams may be disposed along the circumference of basket 1. As basket 1 rotates, the 15 welding seams will contact trip lever 136, which in turn opens pneumatic valve 138, 15 times per rotation. Thus, 15 pneumatic pulses per rotation are sent to control box 34. Pulse counter 142 (FIG. 15), housed in control box 34, counts the pneumatic pulses received from motion detector 38 and allows carriage assembly 10 to be moved radially inward after a predetermined number of pulses are received. The predetermined number of pulses received is directly dependent on the number of protrusions disposed around the circumference of basket 1, as discussed above.

Figure 11:
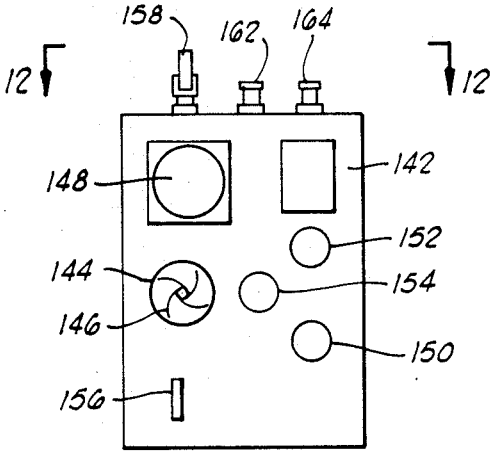
FIG. 11 is a front view of the pneumatic control box showing the controls thereon.

FIG. 11 is a front view of control panel 34 which shows the control components which will be used by an operator running the air preheater cleaning job.

Motor operation indicator 144 is placed in the pneumatic input supply line and blades 146 rotate when pneumatic power is supplied to pneumatic motor 18. Reference numeral 148 represents a regulator which cleans, filters, and regulates the pressure of the pneumatic air supply input to the pneumatic logic control circuit, housed within control box 34. Pulse counter 142 displays the number of pneumatic pulses received from motion detector 38. Directional valve 150 sets the pneumatic logic control circuit such that the direction carriage 10 travels is either forward (toward idler bracket assembly 26) or reverse (toward drive assembly 16). Directional valve 150 is depressed to initiate forward motion and pulled outward to initiate reverse motion. Carriage move valve 152 effects the actual movement of carriage 10 by applying pneumatic power to pneumatic motor 18 when carriage move valve 152 is depressed. Pressure gauge 154 provides the operator an indication of the pneumatic pressure output from regulator 148. This is the pressure that operates the components of the pneumatic logic control circuit and is operator adjustable by changing the setting of regulator 148. Speed control switch 156 is used in conjunction with the variable speed control apparatus, described below.

Figure 12:
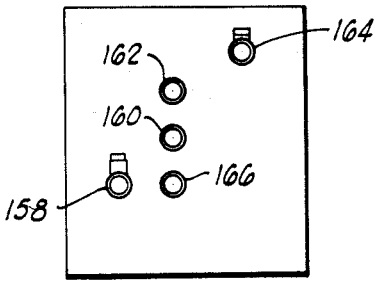
FIG. 12 is a rear view of the pneumatic control box of the present invention illustrating the pneumatic connections thereto.

Interconnections between control box 34 and motion detector 38, and that portion of the pneumatic logic control circuit housed in compartment 36 and the pneumatic supply at the air preheater job site are made using the pneumatic fittings shown in FIG. 12. In particular: air supply fitting 158 receives plant supply air in; fittings 160 and 166 connect with hose assemblies 39 and 42 running to motion detector 38; fitting 164 interconnects control box 34 with pneumatic motor 18, via hose assembly 44; and fitting 162 is used to supply a reverse control function to pneumatic motor 18 for reversing carriage assembly 10 on Ljungstrom cleaning jobs, via hose assembly 46.

Figure 13:
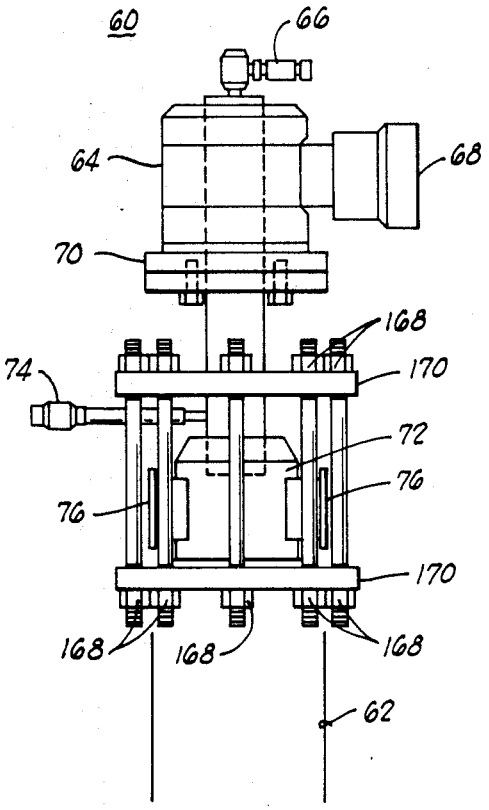
FIG. 13 is an elevational view of the swivel assembly, of the present invention, showing the pressurized water input and output nozzles, the pneumatic control power input and output fittings and the rotating coupling.

FIG. 13 depicts swivel assembly 60 which must be used on Rothmuhle air preheater cleaning jobs. As previously discussed, swivel 60 includes a stationary input manifold 64 having pneumatic input fitting 66 and water input nozzle 68. Rotating coupling 70 allows rotating output manifold 72 to rotate with respect to input manifold 64, and allows output manifold 72 to remain stationary with respect to air input duct 58 and the air preheater cleaning apparatus attached thereto. Rotating coupling 70 includes O-ring seals and bushings which allow the rotating movement thereof.

The weight and rigidity of water hose assembly 13 and pneumatic hose assembly 44 keep input manifold 64 in a stationary position. As can be seen, output air fitting 74 and output water nozzles 76 will rotate with output manifold 72. Depending on air preheater cleaning job characteristics, more than one hose assembly may be used to provide pressurized water to water jet manifold assembly 110.

Swivel assembly 60 is attached to air input duct 58 via shaft 62 which is usually cut and replaced with flanges 170 and threaded connectors 168 such as screws, which are used to rigidly affix swivel assembly 60 to air input duct 58 through attached the flanges 170 installed on the air input duct shaft 62.

As previously noted, reverse motion of carriage assembly 10 is not provided for Rothmuhle air preheater cleaning jobs The addition of another pneumatic path and the associated fittings required to allow a reverse pneumatic control signal to pass through the swivel assembly 60 could be readily accomplished by fabricating a modified swivel assembly 60. However, the contemplated best mode of the present invention does not include a reverse movement function for carriage assembly 10 on Rothmuhle air preheater cleaning jobs, due to economic considerations including the fact that Rothmuhle air preheaters make up only approximately 10 percent of the air preheaters in existence.

Figure 14:
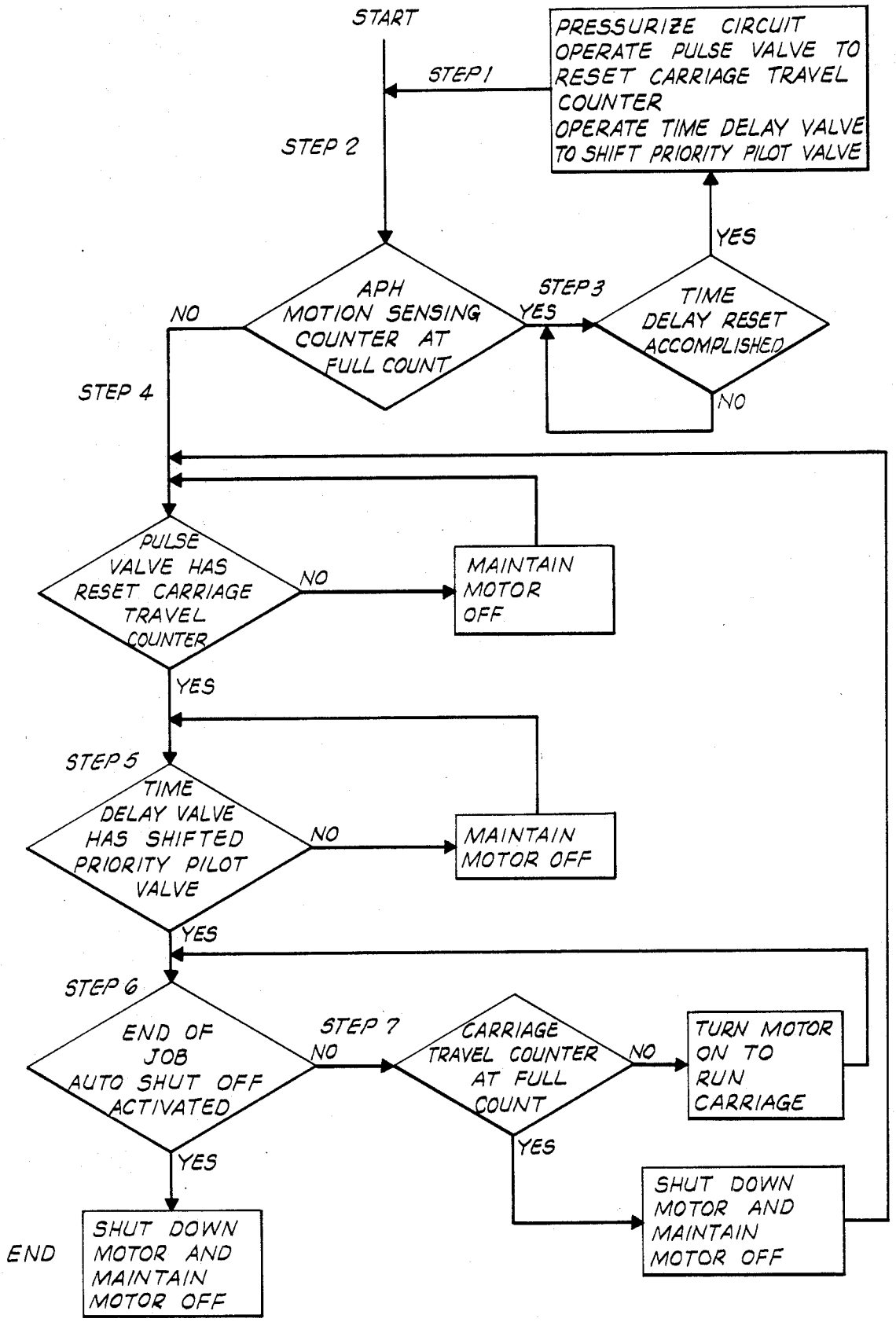
FIG. 14 is a flow chart showing the logic operation of the pneumatic logic control circuit of the present invention.

The operation of the pneumatic logic control circuit which is housed in control box 34 and compartment 36 will now be explained in conjunction with FIG. 14. To begin operation, the pneumatic circuit is pressurized through air supply fitting 158 (step 1). Next, at step 2, the motion detector pulse counter 142 decides if the predetermined number of pulses have been received. If the predetermined number of pulses have been counted by pulse counter 142, then step 3 determines if a time delay reset is accomplished.

If the time delay reset has in fact been accomplished (step 3), then the pneumatic logic control circuit returns to step 1. If the time delay reset has not been accomplished, then the system keeps checking until time delay reset occurs.

If, in step 2, motion detector pulse counter 142 has not received the predetermined number of pneumatic pulses from motion detector 38, then the operation proceeds to step 4, where it is determined if the carriage travel counter 116 has been reset. If counter 116 has not been reset, then motor 18 is maintained off until carriage travel counter 116 is in fact reset.

If it is determined at step 4 that counter 116 has been reset, then the operation proceeds to step 5 where a determination is made whether the time delay valve has shifted the priority pilot valve..If the priority pilot valve has not been shifted, then motor 18 is maintained off until the shifting of the priority pilot valve occurs.

If it was determined at step 5 that the priority pilot valve has been shifted, then the operation proceeds to step 6 where it is determined if the job has been completed. If step 6 indicates that the job is completed, then the system shuts down motor 18 which is maintained off.

If the job has not been completed, then the operation goes to a step 7 where it is determined if carriage travel counter 116 is at full count. If carriage travel counter 116 is not at full count, then the motor 18 is operated and the system returns to step 6.

If the travel counter 116 (step 7) is at full count, then the motor 18 is shut down and the system returns to step 4.

Thus, when the pneumatic power is initially applied, pneumatic motor 18 will begin to operate because: the motion detector 38 will not have sensed the predetermined number of pulses; carriage travel counter 116 is reset (since no movement of carriage 10 has yet occurred); the priority pilot valve is at the shifted (initial position); and the pneumatic limit switch 48 has not indicated the end of the cleaning job. Therefore, pneumatic motor 18 will move carriage 10 inward until carriage travel counter 116 indicates that the desired incremental distance has been traveled.

To summarize the operation of the air preheater cleaning apparatus for a Ljungstrom cleaning job according to the present invention, basket 1 should be rotated by an outside source such as a plant air motor or the like. Next, water jet nozzles 112 are set to the desired pattern and the carriage assembly 10 is placed at the outer circumference 2 of basket 1 and pressurized water is applied to cleaning assembly 12. Thus, a circular path along the outside circumference 2 of basket 1 will be cleaned. Finally, after the basket has completed a desired number of rotations, pneumatic power is applied, the pneumatic logic control circuit is pressurized and pneumatic motor 18 operates to move carriage 10 inward a predetermined distance, as set by predetermining counter 118. Automatic operation is now initiated and after the predetermined number of pulses, which indicate the rotation of basket 1, are counted by pulse counter 142, pneumatic power is supplied to motor 18 which drives carriage assembly 10 inward the desired incremental distance to clean a circular path of basket 1 having a circumference which decreases as cleaning assembly 12 moves inward.

Figure 15:
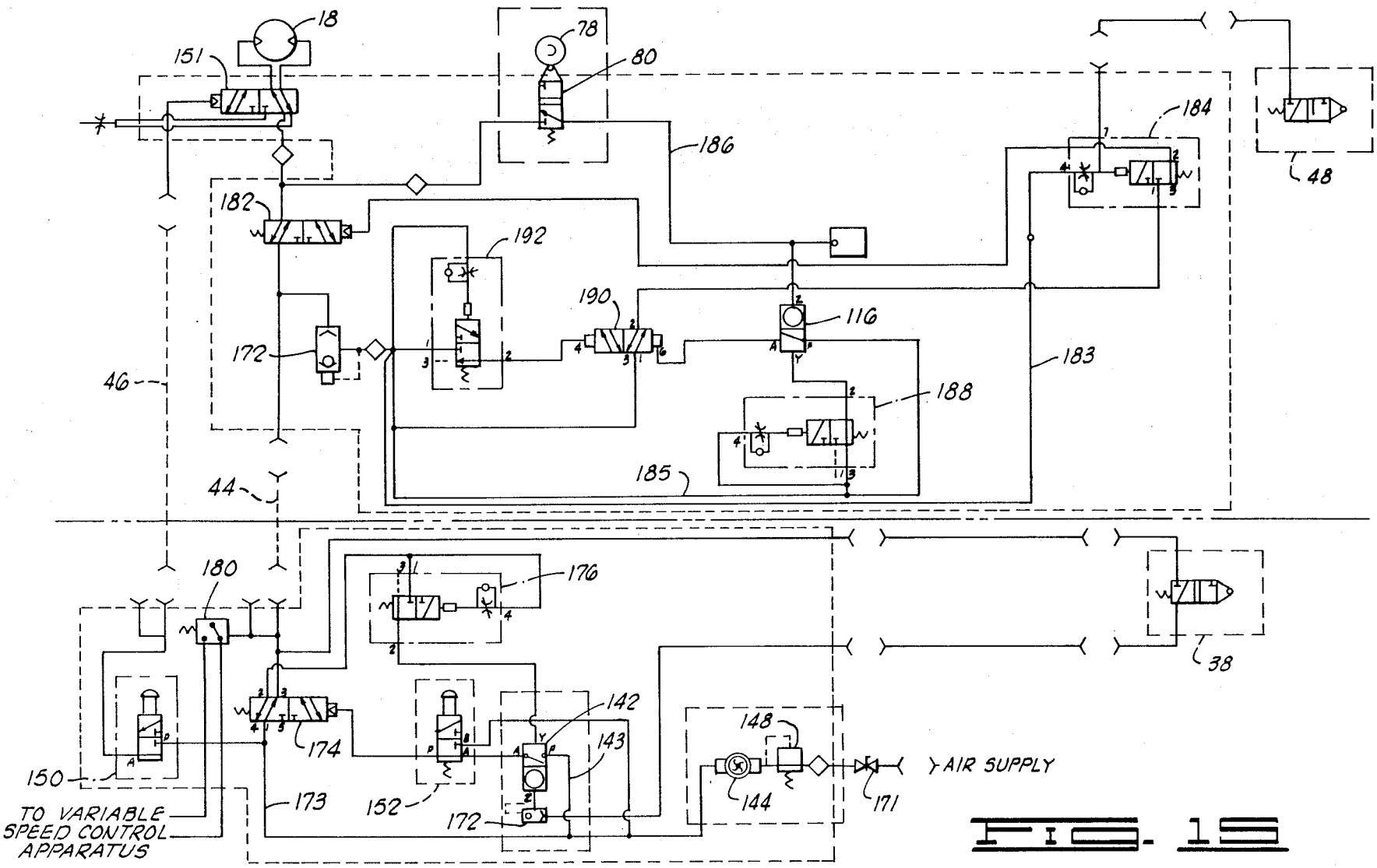
FIG. 15 is a schematic diagram depicting the various components of the pneumatic logic control circuit.
Figure 10:
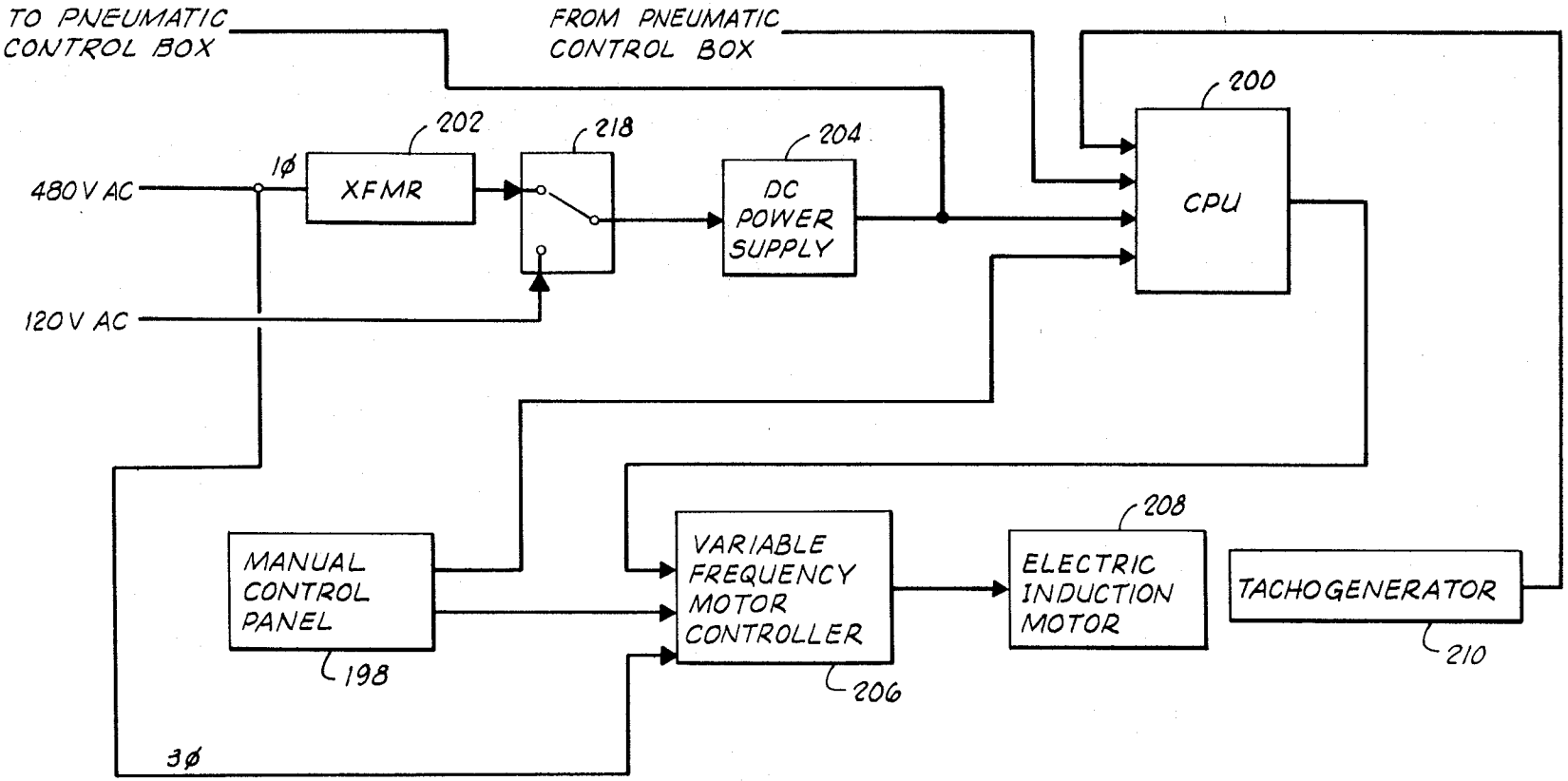
Figure 15:
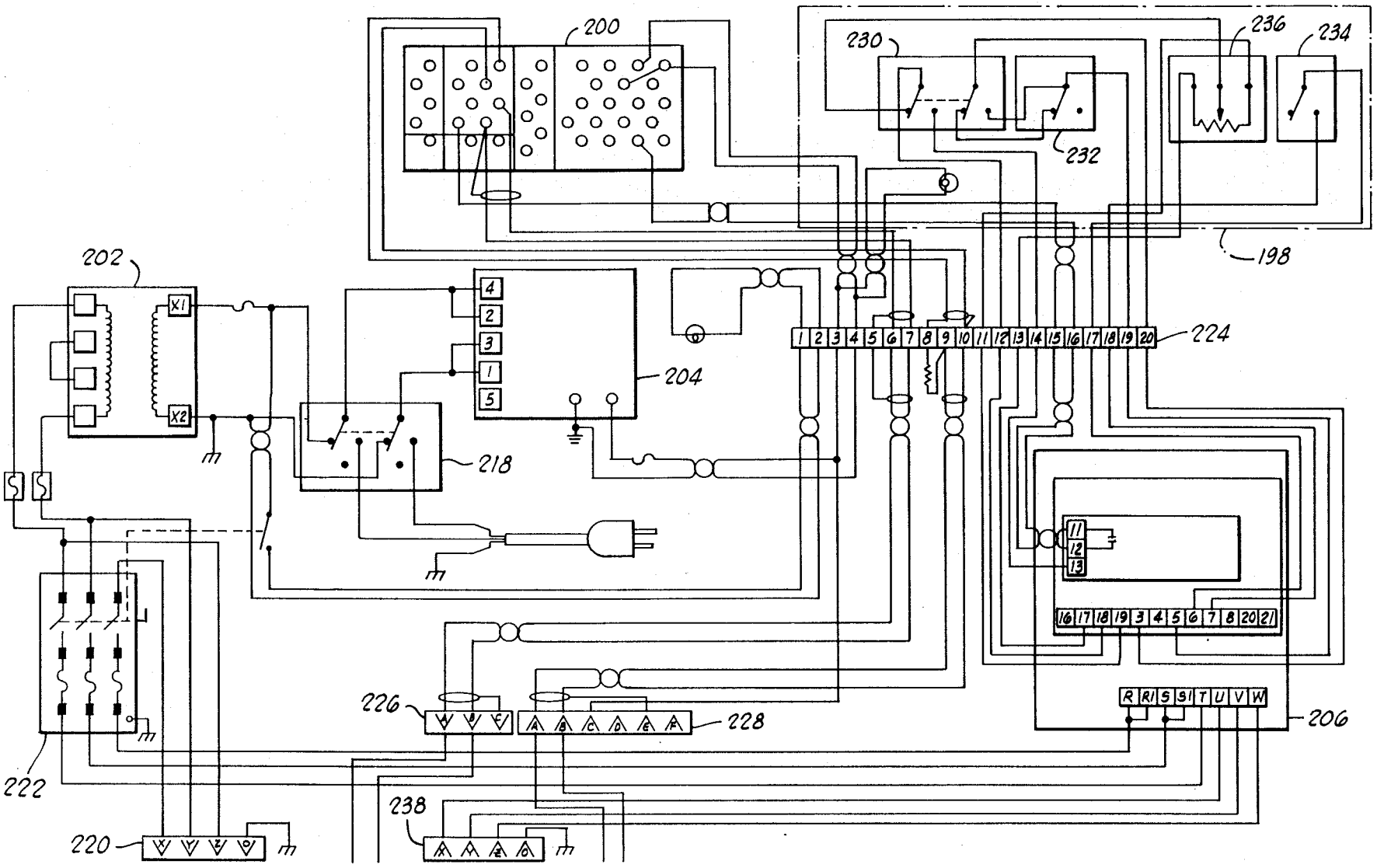

The components of the pneumatic logic control circuit will now be described with reference to FIG. 15. Pneumatic power is input to control box 34 via a butterfly valve 171 which allows the operator to turn on, or shut off, the air supply to the pneumatic logic control circuit. The pneumatic pressure is then regulated and filtered by passing through regulator 148. Motor operation indicator 144 then provides a visual indication of the status of pneumatic motor 18.

The pneumatic power then proceeds to pulse counter 142, via hose section 143, which is an air predetermining counter with manual or pressure reset such as manufactured by Clippard Instrument Lab, or the like. A quick exhaust valve 172, such as a poppet type quick exhaust valve manufactured by Clippard Instrument Lab, is used in conjunction with counter 142 for improving the system response time during resetting, initiation of pneumatic motor 18 movement and shut down. Pneumatic power simultaneously proceeds, via section 173, to control valve 174, such as four way air pilot manual override valve which is manufactured by Mac Valves, Inc. Control valve 174 provides a means for controlling the pneumatic power which drives pneumatic motor 18 and provides control power to compartment 36. Control valve 174 operates based upon signals received from that portion of the pneumatic logic control circuit which counts the pneumatic pulses from motion detector 38 and is housed in control box 34.

Pulse counter reset valve 176 such as a two position three way delayed acting pilot valve manufactured by Clippard Instrument Lab, resets counter 142 after a predetermined number of pneumatic pulses are counted therein. After the predetermined number of pneumatic pulses are received, counter 142 issues a signal to control valve 174 which operates to open control valve 174, thus allowing pneumatic power to flow therethrough.

Manual drive valve 152, such as a palm button spool air valve, or the like which can be operated manually, allows the operator of the air preheater cleaning job to drive pneumatic motor 18 by depressing manual drive valve 152. Manual drive valve 152 issues a pneumatic signal, which overrides the pneumatic signal issued by counter 142, to control valve 174 allowing pneumatic power to flow therethrough.

The direction of travel of pneumatic motor 18 is controlled by directional control valve 150, such as a palm button spool air valve with a latching feature, and motor input valve 151, such as a four way air pilot manual override air valve manufactured by Mac Valves, Inc. Directional control valve 150 is operated (depressed for forward carriage motion and extended for reverse carriage motion) to send a signal to motor input valve 151. Based upon the signal sent from directional control valve 150, motor input valve 151 directs the pneumatic power to pneumatic motor 18 in such a manner as to operate motor 18 in a forward or reverse direction.

This reverse function allows the air preheater cleaning job to be interrupted and reset. For example, a particular circular path of basket 1 can be recleaned without waiting until the air preheater cleaning job is completed and carriage assembly 10 contacts pneumatic limit switch 48, and the operator totally resets the system. This interrupt and reset function is a feature that is not presently known in the art.

As previously discussed, no reverse function is present in Rothmuhle air preheater cleaning jobs, therefore directional control valve 150 will remain in the forward position throughout a Rothmuhle type cleaning job.

The final major component of the pnematic logic control circuit which is housed in control box 34 is a voltage output circuit 180 for issuing the speed control signal to the variable speed control apparatus (discussed below). When the variable speed control apparatus is used, switch 156 (FIG. 11) is closed and as pneumatic motor 18 is operated, air is input to voltage output circuit 180 thus maintaining the electrical circuit open. Next, pulse counter 142 receives the predetermined number of pulses from motion detector 38 and shifts control valve 174 thus initiating reset of carriage motion reset valve 188. Further, shifting control valve 174 simultaneously closes and energizes voltage output circuit 180 for the duration of the operation of pulse counter reset valve 176. Therefore, the speed control signal is output to the variable speed control apparatus (described below) at initiation of carriage 10 movement.

Next, the pneumatic logic control circuit components contained in compartment 36 will be described, also in conjunction with FIG. 15.

Hose assembly 44 provides pneumatic control power to compartment 36, the pneumatic control power running into a pneumatic power control valve 182, such as a four way air pilot manual override valve manufactured by Mac Valves, Inc., similar to control valve 174. Pneumatic power control valve 182 acts as a relay valve which regulates the actual flow of pneumatic power to motor 18, based upon the signals received from other pneumatic control components housed within compartment 36.

Pneumatic control power branches off hose assembly 44 and flows through quick exhaust valve 172, thereafter the pneumatic control power splits with a first section 183 going to stop valve 184, such as a two position three way delayed acting pilot valve manufactured by Clippard Instrument Lab, which receives the pneumatic stop signal output from pneumatic limit switch 48. The pneumatic power output to motor 18 is halted by a signal sent from stop valve 184 to pneumatic power control valve 182. The second hose section 185, from hose assembly 44, goes to counter 116, such as manual or pressure reset predetermining air counter manufactured by Clippard Instrument Lab, which receives pneumatic count signals from mechanical counter 80, via air hose section 186. Mechanical counter 80 is actually an air valve such as a two position three way ball actuated spring return valve manufactured by Festo. Carriage motion input wheel 78 contacts counter mechanical counter 80, which in turn sends the pulses to 116. Air hose section 185 also sends control power to carriage motion counter reset valve 188, such as the two position three way delayed acting pilot valve manufactured by Clippard Instrument Lab. After a preset number of counts, counter 116 operates and sends a signal to a priority pilot valve 190 such as a two position three way priority valve manufactured by Clippard Instrument Lab, which controls the pneumatic control components by only allowing control signals to be output to pneumatic power control valve 182 when certain conditions are met.

Since motor 18 is running while counter 116 is being operated, when the preset number of counts are received, counter 116 issues a signal, to priority pilot valve 190, to stop motor 18. Further, only after counter 116 has received the preset number of counts corresponding to the desired travel distance of carriage assembly 10 and control pressure has been released and reapplied to carriage motion reset valve 188 by control valve 174 does carriage motion reset valve 188 reset counter 116 in order to begin another incremental distance operating sequence. A time delay valve 192, such as a two position three way delayed acting pilot air valve manufactured by Clippard Instrument Lab, is also provided which shifts priority pilot valve 190 to a position wherein motor 18 will not run during the time period when carriage motion reset valve 188 is resetting counter 116. This feature allows for a high degree of accuracy, regarding the movement of carriage assembly 10, during the period when motor 18 start and stop operations occur. If the time delay valve 192 were not present in this system, motor 18 could potentially false start and move for a short period of time before counter 116 is reset and operating. However, with time delay valve 192 the response of motor 18 and thus system accuracy is greatly enhanced.

The foregoing has described the air preheater cleaning apparatus of the present invention using only pneumatic control power and pneumatic power to run the carriage assembly 10 and cleaning assembly 12 incrementally inward. Hereinafter, a variable speed control apparatus will be described which can be added to the totally pneumatic air preheater cleaning apparatus previously described, on either Ljungstrom or Rothmuhle cleaning jobs The variable speed control apparatus will electronically control the rotational speed of the basket 1, or air input duct 58, in relation to the position of carriage assembly 10. Thus, the time required to complete an air preheater cleaning job can be further reduced holding costly down time to a minimum.

Figure 16:
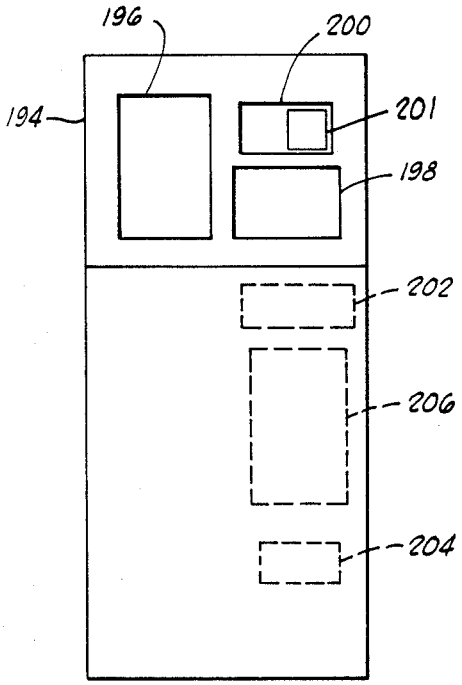
FIG. 16 is a front side elevation of the control panel for the variable speed control apparatus of the present invention.

Referring to FIG. 16, a control stand 194 for the variable speed control apparatus of the present invention is shown. Reference numeral 196 indicates operator instructions for programming the system. Manual controls 198 are provided which the operator can use to manually control the rotational speed of basket 1, or input duct 58, depending on particular job characteristics, e.g. slow rotation if a higher degree of clogging is experienced.

A central processing unit (CPU) 200, including key pad 201, calculates the rotational speed of the basket which is required to maintain a desired surface velocity with respect to cleaning assembly 12, based on the physical characteristics (job data) of the air preheater basket 1. Also, the speed control input from pneumatic control box 34 indicates that carriage assembly 10 has moved and rotational speed should be increased.

The variable speed control apparatus of the present invention also includes a transformer 202, DC power supply 204 and a variable frequency motor controller 206 which will be described in conjunction with FIGS. 18 and 19.

Figure 17:
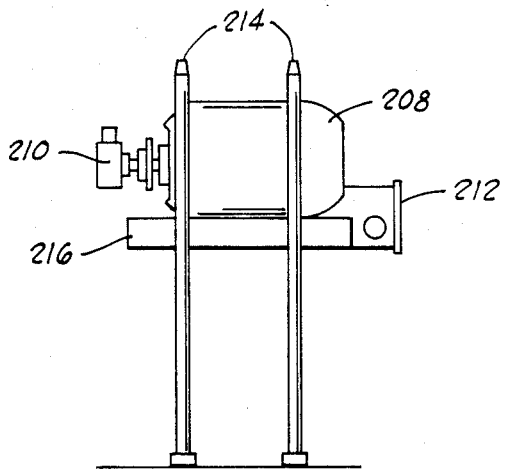
FIG. 17 shows a side elevation of an induction motor and a tachogenerator according to the present invention.

FIG. 17 shows an elevational view of an electric induction motor 208 with a tachogenerator 210 rigidly attached to the shaft of electric motor 208. An electrical connection box 212 is disposed near electric motor 208 and receives the electrical power from variable frequency motor controller 206. Electric motor 208 is mechanically connected by a roller chain and sprocket, or directly to a gear box or the like, for driving basket 1 on Ljungstrom air preheater cleaning jobs and air input duct 58 on Rothmuhle air preheater cleaning jobs. Adjustable legs 214 and motor support bracket 216 allow electric motor 208 to be easily connected to the various types of basket 1 or air input ducts 58 driving means. This adjustment feature of electric motor 208 provides an enhanced degree of flexibility and ease in setting up the variable speed control apparatus of the present invention.

A block diagram illustrating the components of the variable speed control apparatus are shown in FIG. 18. Three phase, 480 volt AC electric power is input to variable frequency motor controller 206. A single phase branch of the 480 volt AC is input to transformer 202, which is commercially available such as Model No. 1497.N5 manufactured by Allen-Bradley Company, and is used to step down single phase 480 volt AC to single phase 120 volt AC. The 120 volt AC is then input to a two position switch 218.

Additionally, single phase 120 volt AC auxiliary power, which is commonly available household current, can be input to switch 218. Thus, control power can be input to the system components from either transformer 202 or an auxiliary power source. This enables the system to be programmed at a location remote to the air preheater to be cleaned (e.g. in the shop prior to shipping to the job site).

The single phase 120 volt AC power is then input to DC power supply 204, which is commercially available such as Model No. HA15-0.9 manufactured by Power One, which rectifies and transforms 120 volt AC to 12 volt DC electric power. This DC voltage is then input to CPU 200 and control box 34 for providing control power.

Manual control panel 198 inputs control signals to CPU 200 and variable frequency motor controller 206, thus controlling an air preheater cleaning job such that the rotational speed can be increased or decreased depending upon characteristics which may vary from job to job.

CPU 200, such as is disclosed as a data acquisition module in co-pending U.S. patent application of Sears et al, Ser. No. 846,533, assigned to Halliburton Company, or another commercially available CPU such as a computer-based processing unit or programmable logic controller (PLC) is used to process the various physical characteristics and dimensions of a particular air preheater cleaning job. Job data, such as air preheater basket inside and outside diameter, desired surface velocity between cleaning assembly 12 and basket 1 and RPM ratio of the air preheater to electric motor 208 are all programmed into CPU 200, via key pad 201. Due to switch 218, this programming can occur prior to the air preheater cleaning apparatus of the present invention leaving its storage location, once the aforementioned variables are provided by the electric utility company.

The voltage speed control signal from pneumatic control box 34 is input to CPU 200. The voltage speed control signal is issued based upon determination by the pneumatic logic control circuit that carriage assembly 10 has moved incrementally inward. CPU 200 continually issues a speed control command to variable frequency motor controller 206 in a range of 0 to 5 volts. CPU 200 then recalculates the rotational speed required by the electric motor 208 to maintain the desired surface velocity between cleaning assembly 12 and basket 1, based on the fact that carriage assembly 10 has moved inward. Next, CPU 200 increases the voltage of the speed control command, issued to variable frequency motor controller 206, thus increasing rotational speed. CPU 200 issues the increased speed control command only after the voltage speed control signal is received from control box 34, indicating that carriage assembly 10 has moved inward another incremental distance.

Tachogenerator 210 may be used and will provide feedback control to CPU 200. Tachogenerator 210 is operatively connected to electric motor 208 and provides a signal which is based upon the actual rotational speed of electric motor 208. Thus, the actual RPM of electric motor 208 is input to CPU 200 and can be used to calculate the speed control command output to variable frequency motor controller 206.

However, in a preferred embodiment, tachogenerator 210 is not used and assumed RPM values are utilized by CPU 200 to calculate the speed control command. These assumed values are preferable, even though a small degree of accuracy may be sacrificed, because if the feedback signal from tachogenerator 210 to CPU 200 is opened, system runaway will occur. That is, if the feedback line is cut or damaged (which can frequently occur in the type of environment where air preheaters are located), CPU 200 will read that the motor is not turning (i.e. RPM=0) and continually increase the speed control command to bring the electric motor 208 up to the rotational speed which has been previously calculated using the programmed job data. If this system runaway happens, severe equipment damage and potential safety hazards will occur. Therefore, the accuracy provided by tachogenerator 210 may not be worth the possibility of equipment and safety problems occurring if the feedback line from tachogenerator 210 to CPU 200 is opened.

Variable frequency motor controller 206 is of a type commercially available, such as Model AF200E 6VAF267B manufactured by General Electric Company. The three phase 480 volt AC is input to variable frequency motor controller 206 along with the speed control command from CPU 200 and manual control signals from manual control panel 198. The three phase 480 volt AC input has a frequency of 60 Hz and variable frequency motor controller 206 varies this frequency based upon (i.e. in direct proportion to) the speed control command from CPU 200, or the manual control signals from control panel 198, and outputs three phase 480 volt AC electric power with a varied frequency to electric motor 208.

Electric motor 208 is an induction type motor which is sensitive to a change in frequency. Thus, as CPU 200 determines that the RPM of electric motor 208 should be increased, variable frequency motor controller 206 correspondingly increases the frequency of the three phase 480 volt AC electric power and the rotational speed of electric motor 208 is increased.

FIG. 19 is a wiring diagram illustrating electrical connections between the various components of the variable speed control apparatus of the present invention. The three phase 480 volt AC 60 Hz electric power is input to a connector 220 and then to a protective device 222, such as fuses or circuit breakers, before being input to variable frequency motor controller 206.

As previously noted, transformer 202 steps down single phase 480 volt AC to single phase 120 volt AC before being input to switch 218. Auxiliary power (i.e. household current) may also be input to switch 218, wherein auxiliary or main power can be selected. Single phase 120 volt AC is input to DC power supply 204 and 12 volt DC is correspondingly output to a main terminal board 224. From terminal board 224, the 12 volt DC branches to CPU 200 and to control box 34. The signal from tachogenerator 210 is input to connector 226 and the signal proceeds to CPU 200 via terminal board 224. Similarly, the voltage speed control signal from control box 34 is input to connector 228 and proceeds to CPU 200 via terminal board 224.

Manual control panel 198 includes manual/automatic switch 230 which the operator uses to select the mode of operation preferred. On/off switch 232 starts operation of the variable speed control apparatus. Reverse/-forward switch 234 allows the operator to control the direction of rotation of electric motor 208. Reference numeral 236 represents a variable resistor (potentiometer) which can be used by an operator to manually control the rotational speed of electric motor 208.

Control signals and commands are issued from CPU 200 and manual control panel 198, via terminal board 224, to variable frequency motor controller 206, which then varies the frequency of the three phase 480 volt AC 60 Hz electric power input from protective device 222, in accordance with these commands. The three phase 480 volt AC power with a varied frequency is then output to connector 238 where it then proceeds to be input to the electrical connection box 212 for input to electric motor 208.

Figure 20:
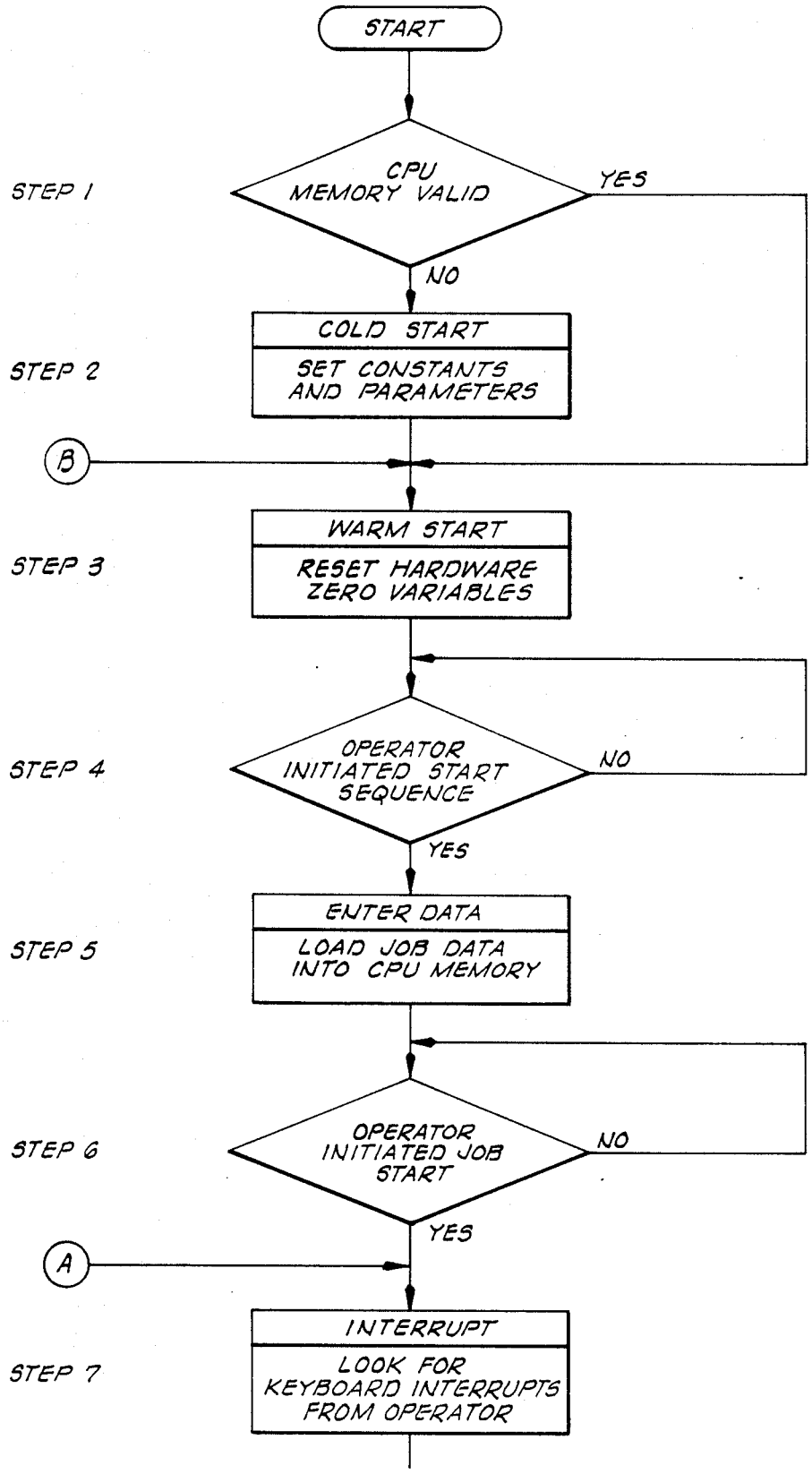
FIG. 20 is a flow chart illustrating the control operations of the central processing unit used in conjunction with the variable speed control apparatus.
Figure 21:
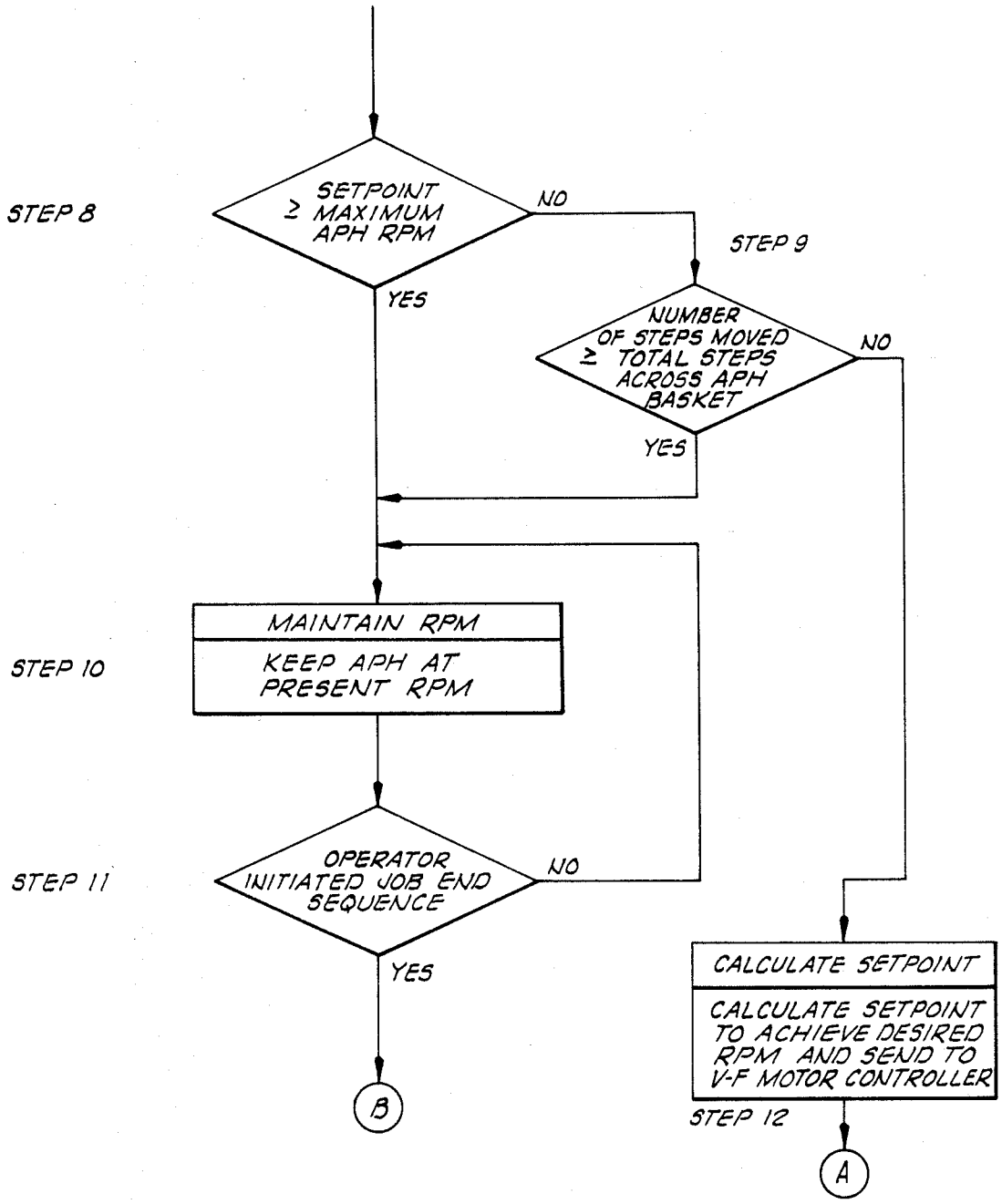
FIG. 21 is a continuation of the flow chart of FIG. 20.

FIGS. 20 and 21 constitute a flow chart depicting the operating sequence of CPU 200. At Step 1, CPU 200 memory is checked for validity i.e. to see if certain constants and parameters are present. Further, if CPU 200 memory is determined not to be valid, then the sequence proceeds to step 2 where a cold start operation begins, that is certain constants and parameters are set and initialized in CPU 200 memory. Among these parameters are whether a tachogenerator 210 is to be used or not.

If the CPU 200 memory is valid, then the sequence skips Step 2 and proceeds to a Step 3, where a warm start operation begins. A warm start includes procedures that: blank displays; check internal clocks; check the output power to motor 208; set proportional, derivative and integral constants; further initialize CPU 200 memory; reset hardware; and zeros variables. CPU 200 is now prepared to calculate the desired rotational speed for the electric motor 208 at a rate of 4 times per second, once the job data are loaded. A warm start (step 3) occurs every time the control power is turned on, whereas a cold start (step 1) may only occur once, (i.e. during manufacture).

Next, the CPU 200 determines at step 4, whether the operator has initiated the start sequence. If yes, the system proceeds to Step 5 where the job data such as basket inside and outside diameter, RPM ratio of the air preheater to electric motor 208 and desired surface velocity are entered, via key pad 201. If the operator has not initiated the start sequence, then the system keeps checking at step 4 until initiation occurs.

After job data are entered, the system moves to step 6 and checks as to whether the operator has initiated the starting of the air preheater cleaning job. If yes, the sequence proceeds to step 7, where the system looks for interruptions by the operator input, via key pad 201, from CPU 200. If the operator has not initiated the job start sequence, then the system keeps checking at step 6 until job initiation occurs.

At step 8, the system checks whether the set point (required air preheater RPM to achieve desired surface velocity) is greater than or equal to a maximum allowable air preheater RPM. If the set point is greater than or equal to the maximum air preheater RPM, then step 10 maintains the air preheater at the present RPM. If the set point is not greater than or equal to the maximum air preheater RPM then the system proceeds to step 9. Step 9 determines if the actual number of incremental steps moved by carriage 10 is greater than or equal to the number of total incremental steps possible across the air preheater basket. If the actual number of steps is greater than or equal to the number of total steps possible, then the system proceeds to step 10. If the number of actual steps is not greater than or equal to the total number of steps possible, then the system proceeds to a step 12. At step 12, the set point is calculated which will achieve the desired air preheater RPM and the set point is then output to variable frequency motor controller 206. Next, the system returns to step 7 and the sequence begins again at that point.

Step 11 checks as to whether the operator has initiated the job end sequence. If no, the system returns to step 10 and maintains the present RPM until the job end sequence is initiated. If the job end sequence is initiated, the system returns to step 3 in which case the power must be turned off to shut down the system.

The main loop of this system is from step 7, to step 8, to step 9, to step 12 and back to step 7. Normally, the set point will be less than the maximum air preheater RPM and the number of actual steps will be less than the total number of steps possible across the air preheater basket, until the carriage 10 has completed its travel path. and step 9 are limits which do not allow the motor to exceed a predetermined RPM (step 8) and do not let the motor RPM be increased after a predetermined number of actual incremental steps are taken by carriage 10 (step 9).

Although certain preferred embodiments have been shown and described, it should be understood that many changes and modifications may be made therein without departing from the scope of the appended claims.

What is claimed is:

1. An air preheater cleaning apparatus, comprising:

an air preheater, used in conjunction with a steam generator, including a basket having a plurality of heat exchange elements arranged in a circular configuration, wherein a portion of the basket is exposed to exhaust gases containing heat energy which are emitted from said steam generator via an exhaust duct and another portion of said basket is exposed to air, used for combustion, which is being input to said steam generator via an air input duct, said heat energy being transferred from said exhaust gas to said input air by rotating said basket;

first means for cleaning said basket, a said basket is being rotated, by emitting pressurized water received from an outside source, in a direction such that contact with said rotating basket is achieved;

second means, operatively connected to said first means, for incrementally moving said first means along a radial line which is parallel to the plane of said basket and extends from the center of said basket to the outside circumference of said basket;

third means, disposed along the circumference of said basket, for providing a force to effect the incremental movement of said second means;

fourth means, disposed at substantially the center of said basket, for limiting the inward incremental movement of said second means and for providing a path such that said third means may continually apply the force to said second means;

fifth means, disposed adjacent to said basket, for providing rigid support for said third means and said fourth means, and for providing a track along which the incremental movement of said second means occurs;

sixth means, operatively connected to said second means, said third means and said fourth means for transferring the force provided by said third means to said second means;

seventh means, disposed at a point along the outside circumference of said basket, for detecting the actual rotating movement between said basket and said air preheater cleaner, and for outputting a pneumatic pulse varying in accordance with said detected rotational movement; and eighth means for pneumatically controlling the incremental movement of said second means based upon the pneumatic pulse received from said seventh means, for outputting a pneumatic move signal to said third means, and for outputting a speed control signal varying in accordance with the incremental movement of said second means.

2. An apparatus according to claim 1, wherein said first means includes a cleaning assembly and comprises a water jet manifold with at least one water jet nozzle, disposed thereon, said water jet manifold and said water jet nozzle being adjustable to regulate the direction and intensity of said pressurized water.

3. An apparatus according to claim 2, wherein said second means includes a carriage assembly comprising:

a roller which engages the portion of said fifth means which is opposite to said basket, said roller allows said carriage assembly to travel along said fifth means and said roller being adjustable to allow for engagement with differently configured types of said fifth means;

at least one guide roller for engaging the side portions of said fifth means, and for guiding said carriage assembly along the length of said fifth means, said guide roller being adjustable to allow for engagement with differently configured types of said fifth means;

a hinged section for mounting said carriage assembly on to said fifth means by allowing a portion of said carriage assembly to open and close wherein said carriage assembly encompasses said fifth means when mounting is complete; and means for effecting a mechanical connection between said sixth means and said carriage assembly.

4. An apparatus according to claim 3, wherein said third means includes a drive assembly comprising:

a pneumatic motor;

means for effecting a mechanical connection between said pneumatic motor and said sixth means; and means for securing said drive assembly to said fifth means.

5. An apparatus according to claim 4, wherein said fourth means includes a bracket assembly comprising:

a pneumatic limit switch wherein a pneumatic stop signal is output to said eighth means upon contact of said carriage assembly with said pneumatic limit switch;

means for securing said bracket assembly to said fifth means; and means for effecting a mechanical connection between said bracket assembly and said sixth means.

6. An apparatus according to claim 5, wherein said fifth means comprises a channel beam.

7. An apparatus according to claim 5, wherein said sixth means comprises a roller chain.

8. An apparatus according to claim 5, wherein said seventh means includes a motion detector comprising:

sensing means for detecting the rotational movement of said basket wherein said basket trips said sensing means a predetermined number of times per each rotation of said basket;

means for securing said seventh means at a position where said sensing means contacts said basket.

9. An apparatus according to claim 8, wherein said eighth means includes a pneumatic logic control circuit comprising:

input means for receiving a pneumatic supply source, for regulating the quality of said pneumatic supply, and for providing a visual indication of the status of said pneumatic motor;

first counting means for receiving said pneumatic pulses from said motion detector, and for counting the number of said pneumatic pulses;

first reset means for resetting said first counting means after a predetermined number of pneumatic pulses are received and a predetermined amount of time has elapsed since the last one of said pneumatic pulses has been received;

manual drive means for providing a signal to initiate and maintain said carriage assembly movement; and direction means for setting the direction said carriage assembly will move toward one of said drive assembly and said bracket assembly, wherein the air preheater cleaning job can be interrupted and reset to a previous position by utilizing said manual drive means and said directional means.

10. An apparatus according to claim 9 wherein said input means, said first counting means, said first reset means, said manual drive means and said directional means are disposed in a control box.

11. An apparatus according to claim 10, wherein said pneumatic logic control circuit further comprises:

second counting means for measuring the inward incremental movement of said carriage assembly;

second reset means for resetting said second counting means after said carriage assembly has moved incrementally inward a predetermined distance;

time delay means for preventing said pneumatic motor from operating during the time period when said second reset means is resetting said second counting means;

stop means for halting the incremental inward movement of said carriage assembly, based on said pneumatic stop signal output from said pneumatic limit switch.

12. An apparatus according to claim 11 wherein said second counting means, said second reset means, said time delay means and said stop means are disposed on said drive assembly.

13. An apparatus according to claim 12 wherein the connection between said control box and said drive assembly comprises:

a first pneumatic hose assembly for providing pneumatic power to said drive assembly to operate said pneumatic logic control circuit and said pneumatic motor; and a second pneumatic hose assembly for providing pneumatic power to said drive assembly for operating said pneumatic motor in a reverse direction toward said drive assembly.

14. An air preheater cleaning apparatus, comprising:

an air preheater, used in conjunction with a steam generator, including a stationary basket having a plurality of heat exchange elements arranged in a circular configuration, wherein a portion of the basket is exposed to exhaust gases containing heat energy which are emitted from said steam generator via an exhaust duct and another portion of said basket is exposed to air, used for combustion, which is being input to said steam generator via an air input duct, said heat energy being transferred via said basket from said exhaust gas to said input air by rotating said air input duct;

first means for cleaning said basket, as said air input duct is being rotated, by emitting pressurized water received from an outside source, in a direction such that contact with said basket is achieved;

second means, operatively connected to said first means, for incrementally moving said first means along a radial line which is parallel to the plane of said basket and extends from the center of said basket to the outside circumference of said basket;

third means, disposed along the circumference of said basket for providing a force to effect the incremental movement of said second means;

fourth means, disposed at substantially the center of said basket, for limiting the inward incremental movement of said second means and for providing a path such that said means may continually apply the force to said second means;

fifth means, disposed on said air input duct and adjacent to said basket, for providing rigid support for said third means and said fourth means, and for providing a track along which the incremental movement of said second means occurs;

sixth means, operatively connected to said second means, said third means and said fourth means for transferring the force provided by said third means to said second means;

seventh means, disposed at a point along the outside circumference of said basket, for detecting the actual rotating movement between said air input duct and said stationary basket and for outputting a pneumatic pulse varying in accordance with said detected rotational movement of said air input duct;

eighth means for pneumatically controlling the incremental movement of said second means based upon the pneumatic pulse received from said seventh means, for outputting a pneumatic move signal to said third means, and for outputting a speed control signal varying in accordance with the incremental movement of said second means; and ninth means for allowing said air preheater cleaning apparatus to swivel 360 degrees with respect to said stationary basket, wherein said pressurized water is routed to said first means and said pneumatic move signal is routed to said third means via said ninth means.

15. An apparatus according to claim 14, wherein said first means includes a cleaning assembly and comprises a water jet manifold with at least one water jet nozzle, disposed thereon, said water jet nozzle being adjustable to regulate the direction and intensity of said pressurized water.

16. An apparatus according to claim 15, wherein said second means includes a carriage assembly comprising:

a roller which engages the portion of said fifth means which is opposite to said basket, said roller allows said carriage assembly to travel along said fifth means and said roller being adjustable to allow for engagement with differently configured types of said fifth means;

at least one guide roller for engaging the side portions of said fifth means, and for guiding said carriage assembly along the length of said fifth means, said guide roller being adjustable to allow for engagement with differently configured types of said fifth means;

a hinged section for mounting said carriage assembly on to said fifth means by allowing a portion of said carriage assembly to open and close wherein said carriage assembly encompasses said fifth means when mounting is complete; and means for effecting a mechanical connection between said sixth means and said carriage assembly.

17. An apparatus according to claim 16, wherein said third means includes a drive assembly comprising:

a pneumatic motor;

means for effecting a mechanical connection between said pneumatic motor and said sixth means; and means for securing said drive assembly to said fifth means.

18. An apparatus according to claim 17, wherein said fourth means includes a bracket assembly comprising:

a pneumatic limit switch wherein a pneumatic stop signal is output to said eighth means upon contact of said carriage assembly with said pneumatic limit switch;

means for securing said bracket assembly to said fifth means; and means for effecting a mechanical connection between said bracket assembly and said sixth means.

19. An apparatus according to claim 18, wherein said fifth means comprises a channel beam.

20. An apparatus according to claim 18, wherein said sixth means comprises a roller chain.

21. An apparatus according to claim 18, wherein said seventh means includes a motion detector comprising:

sensing means for detecting the rotational movement of said air input duct wherein said air input duct trips said sensing means a predetermined number of times per each rotation of said air input duct;

means for securing said seventh means at a position where said sensing means contacts said rotating air input duct.

22. An apparatus according to claim 21, wherein said eighth means includes a pneumatic logic control circuit comprising:

input means for receiving a pneumatic supply source, for regulating the quality of said pneumatic supply, and for providing a visual indication of the status of said pneumatic motor;

first counting means for receiving said pneumatic pulses from said motion detector, and for counting the number of said pneumatic pulses;

first reset means for resetting said first counting means after a predetermined number of pneumatic pulses are received and a predetermined amount of time has elapsed since the last one of said pneumatic pulses has been received;

manual drive means for providing a signal to initiate and maintain said carriage assembly movement; and directional means for setting the direction said carriage assembly will move toward said bracket assembly, wherein the air preheater cleaning job can be interrupted and said carriage assembly can be advanced inwardly by utilizing said manual drive means and said directional means.

23. An apparatus according to claim 22, wherein said input means, said first counting means, said first reset means and said manual drive means are disposed in a control box.

24. An apparatus according to claim 23, wherein said pneumatic logic control circuit further comprises:

second counting means for measuring the inward incremental movement of said carriage assembly;

second reset means for resetting said second counting means after said carriage assembly has moved incrementally inward a predetermined distance;

time delay means for preventing said pneumatic motor from operating during the time period when said second reset means is resetting said second counting means; and stop means for halting the incremental inward movement of said carriage assembly, based o said pneumatic stop signal output from said pneumatic limit switch.

25. An apparatus according to claim 24 wherein said second counting means, said second reset means, said time delay means and said stop means are disposed on said drive assembly.

26. An apparatus according to claim 25 wherein the connection between said control box and said drive assembly comprises a first pneumatic hose assembly for providing pneumatic power to said drive assembly to operate said pneumatic logic control circuit and said pneumatic motor.

27. An apparatus according to claim 26, wherein said ninth means includes a swivel assembly, comprising:

a stationary input manifold including a water input nozzle for receiving pressurized water from an outside source and a pneumatic input fitting for receiving said pneumatic power for said pneumatic logic control circuit and said pneumatic motor from said first pneumatic hose assembly;

a rotating output manifold including at least one water output nozzle for providing said pressurized water to said cleaning assembly and a pneumatic output fitting for providing said pneumatic power for said pneumatic logic control circuit and said pneumatic motor to said drive assembly; and a rotating coupling which allows said input manifold to remain stationary and allows said output manifold to synchronously rotate in conjunction with the rotation of said air input duct;

wherein said pressurized water and said pneumatic power to said rotating output manifold are provided via said rotating coupling.

28. An apparatus according to claim 1 or 14 further comprising:

an electric induction motor, operated by a main alternating current (AC) electric power supply, said electric induction motor being mechanically connected to one of said basket and said air input duct;

central processing means for calculating a desired rotational speed of one of said basket and said air input duct based upon previously programmed air preheater characteristics and said speed control signal output from said eighth means, and for outputting a speed control command based upon said calculated desired rotational speed, wherein the desired rotational speed increases as said second means moves incrementally inward such that the effective speed between said first means and one of said basket and said air input duct remains constant as said second means moves incrementally inward toward the rotational axis of one of said basket and said air input duct; and motor control means for varying the frequency of the AC electric power input to said electric induction motor in accordance with said speed control command.

29. An apparatus according to claim 28, wherein said central processing means comprises a key pad which allows programming and manual control of said central processing means.

30. An apparatus according to claim 29, further comprising:

a manual control panel which can issue a manual speed command to said central processing means and said motor control means, wherein said manual speed command allows said electric induction motor to be operated without said central processing means.

31. An apparatus according to claim 30, further comprising:

a direct current (DC) power supply which converts alternating current (AC) electric power to DC electric power and provides said DC electric power to said central processing means.

32. An apparatus according to claim 31, further comprising:

switching means for providing said AC electric power to said direct current power supply from one of said main AC electric power supply and an outside source such that said central processing means can be programmed with the air preheater characteristics at a location remote to said air preheater.

33. An apparatus according to claim 32, further comprising:

a tachogenerator, operatively connected to the shaft of said electric induction motor, which senses a rotational speed of said electric induction motor and outputs a feedback signal to said central processing means.

34. An air preheater cleaning apparatus, comprising:

an air preheater, used in conjunction with a steam generator, including a basket having a plurality of heat exchange elements arranged in a circular configuration, wherein a portion of the basket is exposed to exhaust gases containing heat energy which are emitted from said steam generator via an exhaust duct and another portion of said basket is exposed to air, used for combustion, which is being input to said steam generator via an air input duct, said heat energy being transferred from said exhaust gas to said input air by rotating said basket;

first means for cleaning said basket, as said basket is being rotated, by emitting pressurized water received from an outside source, in a direction such that contact with said rotating basket is achieved;

second means, operatively connected to said first means, for incrementally moving said first means along a radial line which is parallel to the plane of said basket and extends from the center of said basket to the outside circumference of said basket;

third means, disposed along the circumference of said basket, for providing a force to effect the incremental movement of said second means;

fourth means, disposed at substantially the center of said basket, for limiting the inward incremental movement of said second means and for providing a path such that said third means may continually apply the force to said second means;

fifth means, disposed adjacent to said basket, for providing rigid support for said third means and said fourth means, and for providing a track along which the incremental movement of said second means occurs;

sixth means, operatively connected to said second means, said third means and said fourth means for transferring the force provided by said third means to said second means;

seventh means, disposed at a point along the outside circumference of said basket, for detecting the actual rotating movement between said basket and said air preheater cleaner, and for outputting a pneumatic pulse varying in accordance with said detected rotational movement; and eighth means for pneumatically controlling the incremental movement of said second means based upon the pneumatic pulse received from said seventh means, for outputting a pneumatic move signal to said third means, and for outputting a speed control signal varying in accordance with the incremental movement of said second means.

an electric induction motor, operated by a main alternating current (AC) electric power supply, said electric induction motor being mechanically connected to one of said basket and said air input duct;

central processing means for calculating a desired rotational speed of one of said basket and said air input duct based upon previously programmed air preheater characteristics and said speed control signal output from said eighth means, and for outputting a speed control command based upon said calculated desired rotational speed, wherein the desired rotational speed increases as said second means moves incrementally inward such that the effective speed between said first means and one of said basket and said air input duct remains constant as said second means moves incrementally inward toward the rotational axis of one of said basket and said air input duct; and motor control means for varying the frequency of the AC electric power input to said electric induction motor in accordance with said speed control command.

35. An air preheater cleaning apparatus, comprising:

a substantially circular, rotating air preheater;

carriage means for effecting movement along a radius of said air preheater;

cleaning means, operatively connected to said carriage means, for emitting pressurized fluid in a direction such that contact with said air preheater is achieved;

drive means for providing driving force to said carriage means;

carriage control means for determining when the movement of said carriage means is to occur, and for initiating the movement of said carriage means; and variable speed control means for automatically controlling the rotating speed of said air preheater based upon the actual position of said carriage means.

36. An apparatus according to claim 35, wherein said air preheater cleaning apparatus further comprises swivel means for allowing said cleaning apparatus to rotate 360 degrees with respect to said air preheater.

* * * * *